US008739991B2

(12) United States Patent
Moore et al.

(10) Patent No.: US 8,739,991 B2
(45) **Date of Patent: *Jun. 3, 2014**

(54) STAINLESS STEEL LID PORTION OF A FLUID DISPENSER SYSTEM

(71) Applicant: Pura Stainless LLC, Santa Barbara, CA (US)

(72) Inventors: Roger P. Moore, Santa Barbara, CA (US); Jenifer R. Moore, Santa Barbara, CA (US)

(73) Assignee: Pura Stainless LLC, Santa Barbara, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,668

(22) Filed: Oct. 1, 2013

(65) Prior Publication Data

US 2014/0034598 A1 Feb. 6, 2014

Related U.S. Application Data

(63) Continuation of application No. 13/052,012, filed on Mar. 18, 2011, now Pat. No. 8,573,436.

(60) Provisional application No. 61/315,649, filed on Mar. 19, 2010.

(51) Int. Cl.

| | |
|---|---|
| ***B65D 45/30*** | (2006.01) |
| ***A61J 9/00*** | (2006.01) |
| ***A61J 9/08*** | (2006.01) |

(52) U.S. Cl.

USPC ..... 215/11.1; 215/11.4; 215/11.6; 215/276; 220/319

(58) Field of Classification Search

USPC ..... 215/276, 11.1–11.6; 220/319

See application file for complete search history.

(56) References Cited

U.S. PATENT DOCUMENTS

| | | | |
|---|---|---|---|
| 1,510,363 | A | 9/1924 | Wangen et al. |
| 1,659,784 | A | 2/1928 | Pfister et al. |

(Continued)

FOREIGN PATENT DOCUMENTS

| | | |
|---|---|---|
| AU | 2009200949 | 10/2009 |
| CN | 2813523 | 3/2013 |

(Continued)

OTHER PUBLICATIONS

U.S. Appl. No. 29/431,287, Not yet published, Moore, Jenifer et al.
U.S. Appl. No. 29/454,971, Not yet published, Moore, Roger et al.
Adams, Six baby bottle manufacturers quietly agree to remove BPA from baby bottles, http://www.naturalnews.com/025804_BPA_Baby_Bottles.html, Mar. 9, 2009.

(Continued)

*Primary Examiner* — Fenn Mathew
*Assistant Examiner* — Jennifer Castriotta
(74) *Attorney, Agent, or Firm* — Knobbe Martens Olson & Bear LLP

(57) ABSTRACT

In an embodiment, the device comprises a stainless steel container portion, a stainless steel annular portion, and a silicone mouthpiece portion. Fluid or other contents stored in the device only come in contact with the stainless container portion, the stainless steel annular portion, and the silicone mouthpiece portion. The stainless steel container portion, the stainless steel annular portion, and the silicone mouthpiece portion all do not contain plastic, therefore the fluid in contact with these surfaces is not exposed to any toxins or other compounds found in plastic and therefore the leaching of plastic toxins and compounds cannot occur while the fluid is stored in the device. The mouthpiece portion can be any of a number of different varieties, sizes and shapes.

18 Claims, 21 Drawing Sheets

(56) References Cited

U.S. PATENT DOCUMENTS

| | | | | |
|---|---|---|---|---|
| 1,797,433 | A | 3/1931 | McCrea | |
| 1,998,646 | A | 4/1935 | Yager et al. | |
| 2,008,593 | A | 7/1935 | Pedersen | |
| 2,157,896 | A | 5/1939 | Held | |
| 2,194,004 | A | 3/1940 | Bukolt | |
| 2,438,299 | A | 3/1948 | Relis | |
| 2,449,014 | A | 9/1948 | Shaffer | |
| 3,292,809 | A | 12/1966 | Shomock et al. | |
| 3,445,023 | A | 5/1969 | Giessler et al. | |
| 3,788,510 | A | 1/1974 | Collins | |
| 4,613,050 | A | 9/1986 | Atkin et al. | |
| 4,993,568 | A | 2/1991 | Morifuji et al. | |
| 5,316,160 | A | 5/1994 | Cautereels | |
| 5,544,766 | A | 8/1996 | Dunn et al. | |
| 5,909,820 | A | 6/1999 | Yeh | |
| 6,223,919 | B1 * | 5/2001 | Kuehn | 215/252 |
| 6,371,315 | B1 | 4/2002 | Chien | |
| 6,948,630 | B2 | 9/2005 | Julian et al. | |
| 7,070,065 | B2 | 7/2006 | Wong | |
| D555,795 | S | 11/2007 | Mallet | |
| D588,616 | S | 3/2009 | Tanaka et al. | |
| 7,938,281 | B2 | 5/2011 | Horntrich et al. | |
| 2004/0221385 | A1 * | 11/2004 | Su | 4/678 |
| 2005/0000930 | A1 * | 1/2005 | Weissberg | 215/11.6 |
| 2005/0258201 | A1 | 11/2005 | Willows et al. | |
| 2006/0261064 | A1 | 11/2006 | Holley, Jr. | |
| 2007/0102434 | A1 | 5/2007 | Dunwoody et al. | |
| 2008/0282907 | A1 | 11/2008 | Begin et al. | |
| 2009/0301990 | A1 | 12/2009 | Cresswell et al. | |
| 2011/0226802 | A1 | 9/2011 | Moore et al. | |

FOREIGN PATENT DOCUMENTS

| | | | |
|---|---|---|---|
| EP | 0151862 | A2 | 8/1985 |
| EP | 1354579 | A1 | 10/2003 |
| GB | 2154451 | A1 | 9/1985 |
| GB | 2491790 | | 4/2013 |
| KR | 20-1999-0021881 | | 6/1999 |
| KR | 10-2000-0022013 | | 4/2000 |
| KR | 20-2000-0007813 | | 5/2000 |
| KR | 10-2000-0042244 | | 7/2000 |
| WO | WO 0016731 | A1 | 3/2000 |
| WO | WO 2011/116354 | A2 | 9/2011 |

OTHER PUBLICATIONS

Alter, Time to pack in the polycarbonates, http://www.treehugger.com/green-food/time-to-pack-in-the-polycarbonates.html, Aug. 1, 2007.

Consumer Reports, Major baby bottle manufacturers agree to ban BPA, http://news.consumerreports.org/safety/2009/03/baby-bottle-makers-agree-to-ban-bpa.html, Mar. 9, 2009.

Cornell University, Plastics—Avoiding BPA, http://envirocancer.cornell.eduenvirocancer.cornell.eduhttp://envirocancer.cornell.edu, Mar. 2009.

Daley, Harvard study backs bottle concern, says plastic used leaches Bisphenol A, The Boston Globe www.boston.com/lifestyle/green/articles/2009/05/22/harvard study backs bottle concern and: www.organickidz.ca/stainless-steel-bpa/news-articles, May 22, 2009.

Examination Report issued in United Kingdom Patent Application No. GB1218578.1 dated Oct. 31, 2012.

Garvey, World's first stainless steel baby bottles—safe, strong and sustainable, www.gizmag.com/worlds-first-stainless-steel-baby-bottles/12910, Sep. 22, 2009.

International Search Report and Written Opinion for International Application No. PCT/US2011/029098, Notification mailed Nov. 28, 2011.

Mittelstaedt, Bisphenol A poses disease risk for adults, study says., theglobeandmail.com/technology/science/.../article1061117, Sep. 16, 2008.

Mommyauctions, Bottle raid 2007!, Mommyauctions.com/blog/2007/10/01/kitchen-raid-2007-what's-the-scoop-on-all-the-bpa-free-hype, Oct. 1, 2007.

My Precious Kid, Baby Bottles—BPA free/stainless steel on sale, http://www.myprecious kid.com/blog/2009/10/baby-bottles-bpa-freestainless-steel-on-sale/, Oct. 21, 2009.

Organickidz, About us, www.organikidz.ca/about-us/founder, Pub. Date Unknown.

Stannard, Yale study details how and why of BPA's dangers, www.ehhi.org/plastics/taylor_nhregister_0310.shtml. and: www.organickidz.ca/stainless-steel-bpa/news-articles, Mar. 9, 2010.

Tejada, Avoid Bisphenol A when you can, www.azcentral.com/community/chandler/citizen/articles/2009/05/26/20090526fr-askexpert0527.html, May 26, 2009.

Wellings, Concerns over baby bottles, http://au.news.yahoo.com/today-tonight/latest/article/-/6098435/concerns-over-baby-bottles, Sep. 24, 2009.

Wiley, Stainless Steel Baby Bottles are the best alternative to plastic, voices.yahoo.com/stainless-steel-baby-bottles-best-alternative-2999481.html?cat=25, Mar. 6, 2009.

* cited by examiner

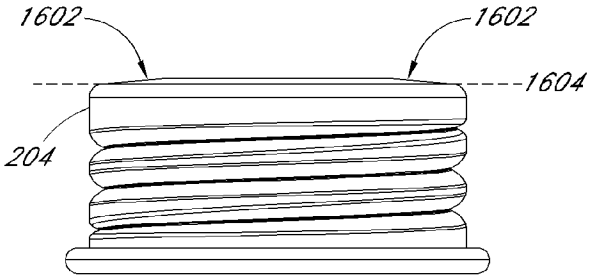
FIG. 16
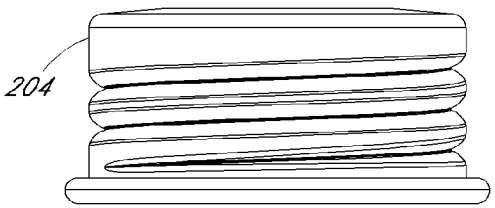
FIG. 17
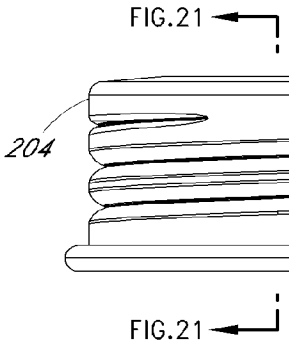
FIG. 18
FIG. 19

STAINLESS STEEL LID PORTION OF A FLUID DISPENSER SYSTEM

CROSS-REFERENCE TO RELATED APPLICATIONS

This application is a continuation of U.S. patent application Ser. No. 13/052,012, titled PLASTIC-FREE DEVICE FOR FLUID STORAGE AND DELIVERY, and filed Mar. 18, 2011, which claims the benefit of U.S. Provisional Application No. 61/315,649, titled ADAPTABLE METAL INFANT AND TODDLER BOTTLES, and filed on Mar. 19, 2010. Each of the foregoing applications is hereby incorporated by reference herein in its entirety.

BACKGROUND

1. Field

This disclosure generally relates to devices for storage and delivery of fluids and other contents, and more particularly, to plastic free bottles for fluid storage and delivery.

2. Description of the Related Art

Various manufacturers produce reusable devices for storing and delivering fluids. For example, there are available reusable water bottles made from a variety of materials, including aluminum and plastic. Many plastic bottles are made from polycarbonate, polystyrene, and/or the like. Plastic is a petroleum-based material and it has been shown to out gas, that is to leach petroleum by products, when subject to repeated heat cycling, for example dishwasher cycles, hot days in the sun or car, continuous use, or the like. One of the most common chemicals used in plastic bottles is Bisphenol A (BPA), which has been linked to developmental problems in children, breast and uterine cancer in women, and altered hormone states in men. Even plastic bottles that claim to be Bisphenol A-free, may still out gas other petroleum by-products and toxins when scuffed, subjected to continuous use, or put through a heated cycle. These toxins and other by-products can include PVC, lead, Bisphenol A, and nitrosamine.

As one example of the potential problems with plastic containers, within the last five years, several government-issued reports have questioned the safety of consumer products made from Bisphenol A. Specifically, in a 2010 report from the United States Food and Drug Administration (FDA), the National Institutes of Health (NIH) and the FDA raised concerns about the potential effects on fetuses, infants, and young children of Bisphenol A on the brain, behavior, and prostate gland. Consequently, the FDA's National Center for Tocological Research is carrying out in-depth studies to answer key questions and clarify uncertainties about the risks of Bisphenol A. In the interim, the FDA is taking reasonable steps to reduce human exposure to Bisphenol A in the food supply. These steps include, among other things, supporting the industry's actions to stop producing Bisphenol A-containing baby bottles and infant feeding cups for the U.S. market.

In addition to the health concerns associated with the use of plastic bottles, there is growing concern about the environmental impact of using plastic bottles. Specifically, it takes 5 liters of water and a quarter liter of oil to produce a single 1 liter disposable water bottle. Accordingly, the manufacture and use of plastic water bottles is not generally eco-friendly nor eco-conscious.

In aluminum bottles and cans, the interior chamber generally is coated with an epoxy-based lining because raw or uncoated aluminum food service products have been linked to Alzheimer's disease. As a result, virtually all aluminum bottles are lined to minimize this risk. Many of these linings have been shown to leach toxins, including Bisphenol A, into the food product contained in the aluminum bottle or can. Additionally, aluminum is a relatively soft metal and is more prone to dents and scratches than stainless steel. As a result of such denting, the internal lining can crack and/or flake off, thereby increasing the potential of releasing undesired materials, such as Bisphenol A into food products and other fluids, such as water. Further the production of aluminum products requires massive amounts of electricity and raw materials. Moreover, the aluminum production for making disposable aluminum cans also emits high levels of greenhouse gases. Accordingly, the use of disposable aluminum cans is also generally not eco-conscious or ecologically friendly.

SUMMARY

Various embodiments of the present invention relate to devices for storage and delivery of fluids and other contents for ingestion by humans. For example, and in accordance with one aspect of an embodiment, the device for storing and delivering fluid or other contents contains no plastic compounds and toxins, such as Bisphenol A, or substantially no plastic compounds and toxins. In an embodiment, the device for fluid storage and delivery comprises only, or substantially only, stainless steel materials and silicone. By manufacturing the device from only stainless steel and silicone materials, the device does not leach harmful plastic compounds and toxins into the fluid or contents stored in the device. It is advantageous to prevent the leaching of plastic compounds and toxins into fluid stored in the device because it helps prevent plastic compounds and toxins exposure to humans that consume the fluid stored in the device. As discussed above, there are concerns about the potential effects of plastic compounds and toxins on the brain, behavior, and prostate gland in fetuses, infants, young children, and adults. Generally, it is preferred to reduce human exposure to plastic compounds and toxins. One way to reduce human exposure to plastic compounds and toxins is to store and deliver fluids and other contents in devices that contain no, or substantially no, plastic compounds and toxins.

Additional features and benefits of the device is the ability to receive a variety of different mouthpiece portions, wherein the mouthpiece portions can be for different purposes, age of users, and having various sizes, shapes, and configurations. In addition, improvements have been found to stainless steel bottles, silicone mouthpieces, the interaction between the components and the modular nature of the design.

According to some embodiments, a Bisphenol A-free system can be useful for storing and delivering fluid. The system can comprise a stainless steel container portion, a stainless steel annular portion, and a silicone mouthpiece portion. In some embodiments, the system can include more than one mouthpiece portion, such as a nipple, spout, sport top, etc. According to some embodiments, fluid in the Bisphenol A-free system can only contact silicone or stainless steel materials while contained in the Bisphenol A-free system.

The stainless steel container portion can define a first inner chamber and have a first end and second end. The first end can be closed and can form a base of the inner chamber. The second end can have an opening and a neck portion, the opening defined by a lip. The lip can be adjacent to the neck portion and can have a smaller outer diameter than an outer diameter of the neck portion.

The stainless steel annular portion can be configured to couple to the stainless steel container portion at the neck portion. The stainless steel annular portion can comprise a first circular opening having a first diameter and configured to be coupled to the stainless steel container portion at the neck portion; a second circular opening having a second diameter, the first diameter being larger than the second diameter; and a top surface being substantially flat.

The silicone mouthpiece portion can define a second inner chamber and can have a base portion and a protruding end extending therefrom. The protruding end can be sized and configured to be received in a human oral cavity. The protruding end can have an aperture in communication with the second inner chamber. The silicon mouthpiece portion can be removably mountable in the stainless steel annular portion to allow the protruding end to extend through the second opening of the stainless steel annular portion.

In some embodiments, the system can further comprise graduation indicators pressed into an exterior surface of the stainless steel container to eliminate depressions in an interior surface of the inner chamber, the graduation indicators being positioned to be exposed and readable from the first inner chamber.

A method can involve storing and delivering a fluid in a Bisphenol A-free device. The method can comprise one or more of the following steps. Storing a fluid in a container. Inserting a removably mountable first mouthpiece portion into an annular portion, the annular portion configured to be coupled to the container portion, the first mouthpiece portion having a base portion and a protruding end extending therefrom, the protruding end extending through a first opening of the annular portion. Coupling the annular portion to the container portion by receiving in a second opening of the annular portion a neck portion of the container portion. Forming a seal between the annular portion and the container portion by compressing the first mouthpiece base portion between a lip portion of the annular portion with a first surface formed by around the opening of the container.

A method can involve storing and delivering a fluid in a Bisphenol A-free device. The method can comprise one or more of the following steps. Storing a fluid in an inner chamber of a stainless steel container portion, the stainless steel container portion having a first end and second end, the first end is closed and forms the base of the inner chamber, the second end having an opening and a neck portion. Inserting a removably mountable first silicone mouthpiece portion into a stainless steel annular portion, the stainless steel annular portion configured to be coupled to the stainless steel container portion, the first silicone mouthpiece portion having a base portion and a protruding end extending therefrom, the protruding end having an aperture in communication with the inner chamber, the protruding end extending through a first opening of the stainless steel annular portion. Coupling the stainless steel annular portion to the stainless steel container portion by receiving in a second opening of the stainless steel annular portion the neck portion of the stainless steel container portion. Forming a seal between the stainless steel annular portion and the stainless steel container portion by compressing the first silicone mouthpiece base portion between a lip portion of the stainless steel annular portion with a first surface formed by a reinforced ridge portion around the opening of the stainless steel container.

Any of the methods can also include decoupling the annular portion from the container portion and removing the first mouthpiece portion from the annular portion. Removably mounting a second mouthpiece portion different from the first on the container portion and forming a seal between the second mouthpiece portion and the container portion by pressing the first surface of the container against the second mouthpiece portion when the annular portion is coupled to the container portion.

A Bisphenol A-free device useful for storing and delivering fluid can comprise a stainless steel container portion having a tubular shape and an inner chamber, and a first end and second end, the first end is closed and forms the base of the inner chamber, the second end having an opening and a neck portion, a stainless steel annular portion configured to be coupled to the stainless steel container portion, the stainless steel annular portion having a first circular opening and a second circular opening, the first circular opening having a first diameter and configured to be coupled to the stainless steel container portion, the second circular opening having a second diameter formed by a lip portion, the first diameter is larger than the second diameter, the neck portion further comprises a first reinforced ridge portion around the opening to create a first surface for compressing a flange of a mouthpiece or spout portion against the lip portion of the stainless steel annular portion, the first surface is smooth to prevent cutting into or damaging the flange while the first surface compresses the flange against the lip portion of the stainless steel annular portion.

The opening of the second end of the stainless steel container portion of the Bisphenol A-free device can be a wide mouth opening and the device can further comprise graduation indicators being readable from the inner chamber.

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

BRIEF DESCRIPTION OF THE DRAWINGS

The foregoing and other features, aspects and advantages of the embodiments of the invention are described in detail below with reference to the drawings of various embodiments, which are intended to illustrate and not to limit the invention. The drawings comprise the following figures in which:

FIGS. 16-19 are side elevation views of an embodiment of an annular portion of the device.

DETAILED DESCRIPTION OF THE EMBODIMENTS

Figure 1:
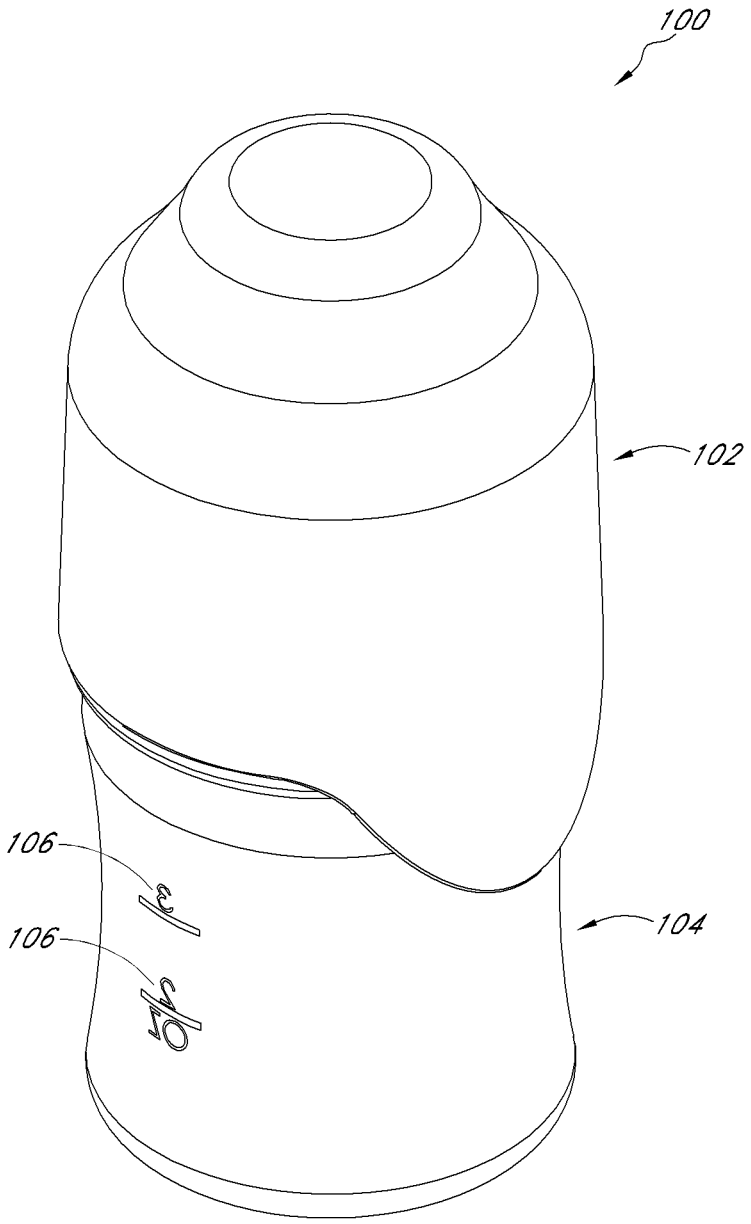
FIG. 1 is a top, front, and right side perspective of an embodiment of a device for storing and delivering fluid and other contents.

Although several embodiments, examples and illustrations are disclosed below, it will be understood by those of ordinary skill in the art that the inventions described herein extend beyond the specifically disclosed embodiments, examples and illustrations, and include other uses of the inventions and obvious modifications and equivalents thereof. Embodiments of the invention are described with reference to the accompany figures, wherein like numerals refer to like elements throughout. The terminology used in the description presented herein is not intended to be interpreted in any limited or restrictive manner simply because it is being used in conjunction with a detailed description of certain specific embodiments. In addition, embodiments described herein can comprise several novel features and no single feature is solely responsible for its desirable attributes or is essential to practicing the inventions herein described.

As indicated in recent reports by the FDA and others, it is advantageous to reduce plastic compounds and toxins exposure to humans, in particular infants, toddlers, and children, as well as adults. To reduce such plastic compounds and toxins exposure, it can be beneficial to substitute the use of plastic bottles or containers that may be laden with various toxins, with a fluid storage and delivery device that contains no plastic. Such a plastic-free device can also be reusable, thereby eliminating or reducing the need for petroleum-based plastic bottles that generally contribute to a massive waste problem. Additionally, the use of the plastic-free fluid storage and delivery devices disclosed herein can also help prevent allergy attacks in those individuals that are allergic to the compounds in plastic bottles and containers.

To prevent and/or reduce an individual's exposure to plastic compounds and toxins, fluids or other substances to be consumed by humans should not come into contact with storage and delivery devices containing plastic compounds and toxins because such containers can leach plastic compounds and toxins into the fluid. Accordingly, the fluid storage and delivery device disclosed herein contains no, or substantially no, plastic compounds and toxins. Specifically, the inner parts of the device that come into contact with fluid contain no plastic compounds and toxins. Therefore, the leaching of plastic compounds and toxins into the fluid being stored in the container is eliminated.

In an embodiment, the device comprises a stainless steel container portion, a stainless steel annular portion, and a silicone mouthpiece portion. The terms "mouthpiece portion," "nipple portion," "spout," "nipple," "sippy spout," "sip spout," and "sport spout," "adult sports top," "sports module," "loop top," "hands free sport top," are broad interchangeable terms, and unless otherwise indicated, the terms can include within their meanings, without limitation, nipple, spout, sippy spout, sip spout, sport spout, spout nipple, pop top, and the like.

Fluid or other contents stored in the device can only come in contact with the stainless container portion, the stainless steel annular portion, and the silicone mouthpiece portion. The stainless steel container portion, the stainless steel annular portion, and the silicone mouthpiece portion all can not contain plastic compounds and toxins, therefore the fluid in contact with these surfaces is not exposed to plastic compounds and toxins and therefore the leaching of plastic compounds and toxins cannot occur while the fluid is stored in the device. By reducing the risk of plastic compounds and toxins leaching into the contents of the device, there is reduced exposure to the user of ingesting Bispenol A or other petroleum-derived toxins.

In an embodiment, the stainless steel used to manufacture the container portion and the annular portion is stainless steel #304, also known as 18/8, which is food-grade stainless steel. Stainless steel #304 is known for its resistance to corrosion and staining, and antibacterial properties. Generally, stainless steel does not react with acidic foods or beverages, therefore the device will not generally affect the flavor of the fluid or other contents stored within the device. In other embodiments, a different grade of stainless steel may be used to manufacture the container portion and the annular portion. Such stainless steel grades may include #204, #202, #301, Chinese Domestic #304 or other unspecific alloy materials. Generally, the foregoing stainless steel materials are less expensive and are inferior grades of stainless steel which typically use manganese as a substitute for nickel. These lower grades of stainless steel do not exhibit the corrosive resistance of #304 and have not generally been certified as food grade stainless steel. Accordingly, it is preferable that the container portion and the annular portion be manufactured with stainless steel #304.

By manufacturing the container portion and the annular portion with #304 stainless steel, there is no need for a liner or inner coating to be placed on the interior surfaces of the container portion or annular portion. In contrast, bottles and containers manufactured from aluminum are coated with a protective liner, generally epoxy-based, due to potential toxicity and reactive issues with raw aluminum. In many cases, the protective liner comprises plastic compounds and toxins that can leach into the fluids or other contents contained within the bottles and containers.

The use of #304 stainless steel to manufacture the annular portion also improves the strength and durability of the annular portion, which is subject to greater wear and tear due to the coupling and decoupling of the annular portion from the container portion. In contrast, annular portions or collars made from plastic generally develop cracks over time due to use. These cracks can cause fluids or other contents in the container to leak out. Annular collars manufactured from #304 stainless steel are generally more durable than annular collars manufactured from plastics, and therefore, are less likely to develop cracks thereby reducing the chances of the fluid or other contents in the device from leaking out. Additionally, the continuous use of plastic annular portions can increase the chances of scraping off plastic fragments that may include Bisphenol A materials or other plastic compounds and toxins that can fall into and contaminate the fluid or contents in the bottle or container. As suggested by FDA reports, these plastic fragments can adversely affect humans if ingested. Accordingly, a stainless steel annular portion not only improves strength and reliability of the annular portion thereby reducing the chances of leakage, but also a stainless steel annular portion protects the fluid or contents inside the container portion from plastic compounds and toxins contamination.

In an embodiment, the annular portion is configured to receive a mouthpiece portion. In use, the annular portion receives the mouthpiece portion and then the annular portion is coupled to the container portion, for example by screwing on the annular portion to a neck portion of the container portion. The annular portion can be coupled to the container portion in a number of different ways, for example the annular portion can be snapped onto the container portion using a friction mechanism or alternatively the annular portion can be coupled to the container portion using a latch mechanism. Other coupling mechanisms are also available and can be used with the devices described herein.

Additional features and benefits of the device is the ability to receive a variety of different mouthpiece portions, wherein the mouthpiece portions can be for different purposes, age of users, and having various sizes, shapes, and configurations.

For example, a user can purchase the device either with one mouthpiece portion or with multiple mouthpiece portions. The device may be packaged as a kit including a variety of different mouthpiece portions. A user could also purchase different mouthpiece portions depending on the stage of life of the users. For example, initially the device can be purchased with the mouthpiece portion being a nipple for a baby. At a later time, a mouthpiece portions being a sippy spout can be purchased and used with the device instead of the nipple. Still later, or really at any time, a mouthpiece portion being an adult spout can also be used with the device. Thus, the device can beneficially provide multiple uses and thereby provide a long and useful life for the product.

As will be seen, the device includes various advances over the prior art in order to enable the device to be used with a variety of mouthpiece portions as described herein.

As a further example, the annular portion can be specifically configured and dimensioned to receive mouthpiece portions having various sizes, shapes, and configurations. In particular, the annular portion can be manufactured to receive mouthpiece portions produced by a variety of manufacturers, thereby improving the versatility and lifetime use of the device. For example, the annular portion can be configured to receive mouthpiece portions having flange regions of various thickness, width, and length. Furthermore, the annular portion can be configured to receive mouthpiece portions configured for different flow rates. For example, the annular portion can be configured to work with mouthpiece portions for a slow flow rate or mouthpiece portions having a fast flow rate. Additionally, the annular portion may be compatible with a wide array of mouthpiece portions, including nipples, sip spouts, and sports spouts manufactured by other companies. The mouthpiece portion may be manufactured from silicone and/or plastic. By allowing the annular portion to be interchangeable with a variety of mouthpiece portions the device can be converted from one purpose to another, for example, a nursing bottle for babies to a sippy cup for toddlers to an adult drinking bottle.

To further reduce human exposure to plastic compounds and toxins, the mouthpiece portion can be manufactured from silicone. Specifically, the mouthpiece portion can be manufactured from medical grade silicone, which can have fewer impurities. Medical grade silicone is generally biocompatible and is regulated by the FDA. Medical grade silicone can be generally grouped into three categories: non-implantable, short term implantable, and long-term implantable. Any of the three categories of medical grade silicone can be used to manufacture the mouthpiece portion.

The use of stainless steel to manufacture the container portion and annular portion of the device not only helps protect against the development of cracks that can cause leaks, but also the stainless steel material helps protect against dents and other breakage during use. In contrast, glass containers are subject to shattering if dropped by the user, and the shattering of a glass bottle can cause significant harm to an infant or a toddler or other user. Unlike glass, the stainless steel container portion will not shatter and will generally not dent depending upon the amount of force applied to the device. Additionally, the stainless steel container portion protects the fluid and contents inside the container from sunlight that can break down vitamin C and other nutrients found in the fluid or other contents. Unlike glass and plastic containers, the stainless steel container portion prevents harmful ultraviolet light and visible light and other radiation from entering the inner chamber of the container portion thereby protecting the taste and nutritional content and safety of the fluid and contents inside the container. Further, the container portion can be configured, shaped, and dimensioned for the hands of a baby, toddler, and/or adult. Specifically, the container portion can be configured with an ergonomic design specifically for the small hands of an infant or toddler.

In some embodiments, the stainless steel container portion can have a single wall or a double wall construction. In addition, the stainless steel container portion can further include insulation between the double wall construction. The insulation can be air or another gas, foam, cloth, and/or other material(s).

The stainless steel container portion can comprise graduations, indicators, or markings pressed into the bottle from the exterior. For example, numbers can be pressed into the exterior of the container portion to indicate the fluid volume at a particular point along the height of the container portion. In an embodiment, the depressions can be visible from the exterior of the container portion as well as the interior of the container portion. The numbering or other indications can be arranged such that the characters appear backwards when viewing the graduation indicators from the exterior of the container portion but appear normal or readable when viewing the graduation indicators from the interior of the container portion. Such a configuration allows the user to easily read the graduation indicators from the interior of the container portion as the user fills the container portion with a fluid or other content. Additionally, by pressing the graduation indicators into the container portion from the exterior, voids or other depressions are eliminated in the interior surface of the container portion. The lack of voids or depressions in the interior surface of the container portion is advantageous because such voids or depressions can trap or catch bacteria, impurities, or other compounds that can contaminate the fluid or other contents in the container portion. Therefore, the cleaning and/or sterilization of the container portion is made easier and more efficient.

Bottle Embodiments

FIG. 1 illustrates an embodiment of the device 100 useful for storing and containing fluids. Generally, the device 100 comprises a substantially tubular configuration. The device 100 can comprise a cover portion 102 that can be positioned over the top of a container portion 104. The container portion 104 can be manufactured from stainless steel, and preferably from #304 stainless steel to prevent plastic compounds and toxins from leaching into the fluid or other contents stored in the device 104.

The container portion can comprise graduation indicators or other markings 106 as described above. For example, the container portion can comprise a two ounce and a three ounce graduation indicator markings as illustrated in FIG. 1. The markings 106 can be pressed into the exterior portion of the container portion 104 such that the graduation markings are backwards when viewing the markings 106 from the exterior of the container portion.

Figure 2:
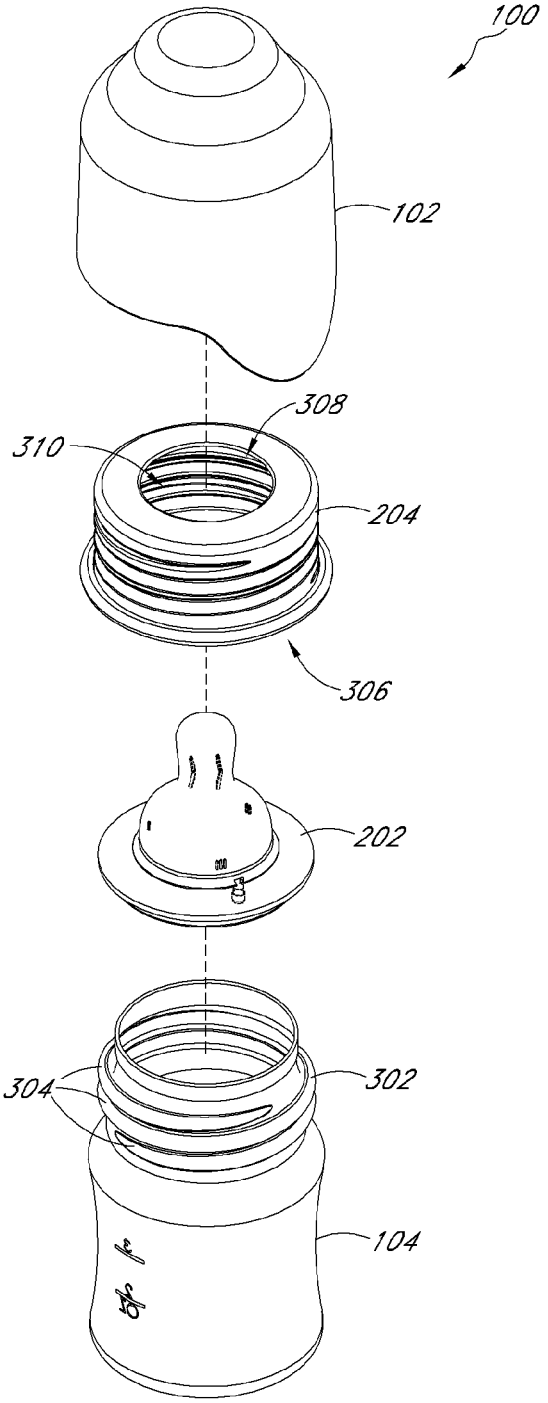
FIG. 2 is a top, front, and right side perspective of an embodiment of the device, wherein the device has been disassembled.

FIG. 2 illustrates a method of combining the various components of the device 100. Specifically, an annular portion 204 is configured to receive the mouthpiece portion 202 through a first opening 306 and through a second opening 308 of the annular portion 204. The annular portion 204 is then coupled to a neck portion 302 of the container portion 104. In an embodiment, the annular portion 204 comprises grooves 310 in the interior portion of the annular portion 204. The grooves 310 are configured to engage a plurality of threads 304 on the neck portion 302 as the annular portion 204 is screwed onto the neck portion 302 of the container portion 104. As described above, other mechanisms and methods of coupling the annular portion 204 to the container portion 104 exist and are contemplated for the device 100. After the annular portion 204 is coupled to the container portion 104, the cover portion 102 can be positioned over the mouthpiece portion 202 and the annular portion 204 to protect the mouthpiece portion 202 from debris and other contaminants.

Figure 3:
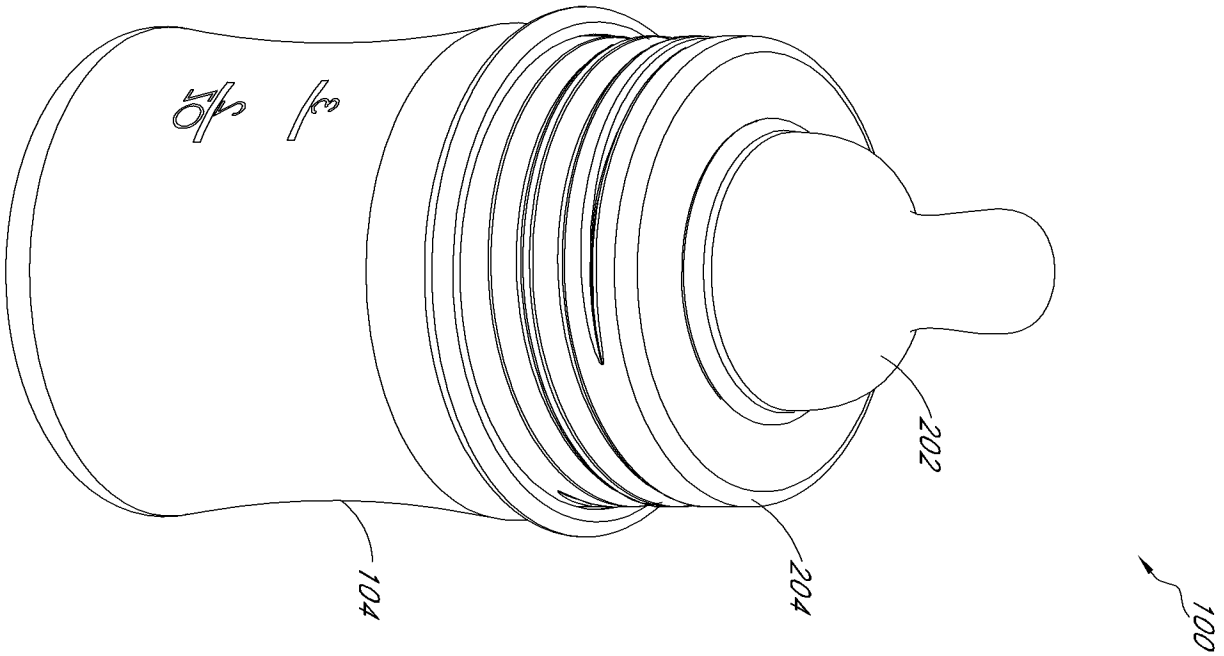
FIG. 3 is a top, front, and right side perspective of an embodiment of the device without a cover portion.

FIG. 3 illustrates the device 100 with the cover portion 102 removed. By removing the cover portion 102, the mouthpiece portion 202 and the annular portion 204 are exposed. As illustrated in FIG. 3, the mouthpiece portion 202 is coupled to the container portion 104 by the annular portion 204.

Figure 3A:
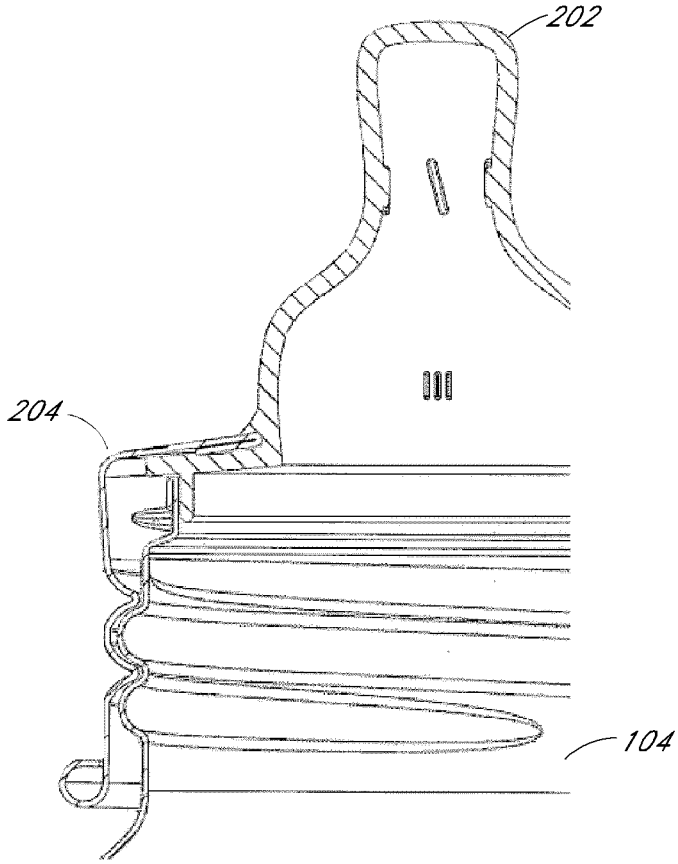
FIG. 3A is a cross-section detail view of the device of FIG. 3.

Turning now to FIG. 3A, a cross-section detail view is shown. As can be seen, the mouthpiece portion 202 can sit on and/or in the container portion 104 and the annular portion 204 can force the mouthpiece portion 202 and the container portion 104 into contact. In this way, a seal can be formed such that liquid does not leak out of the device.

As has been described, the device is configured to function with a variety of different mouthpiece portions 202. The different mouthpiece portions 202 can have a variety of different sizes, shapes, and configurations. It will be appreciated that preventing leaking can be a major difficulty in using different mouthpiece portions 202.

As will be described in more detail below, various features of the device both facilitate the use of different mouthpiece portions 202 while also preventing the device from leaking. These features can include the angle of the top surface of the annular portion 204, the interaction at and around the opening 308 of the annular portion with the mouthpiece portion 202, and the interaction of the opening of the container portion 104 with the mouthpiece portion 202. As shown, the opening of the container portion 104 can also include a stepped down portion having an outer diameter less than the outer diameter of the adjacent neck portion 302, such as at the threads 304. Each of these features can provide unique benefits.

Still referring to FIG. 3A, it can be seen that in the illustrated configuration the annular portion 204 forces the mouthpiece portion 202 and the container portion 104 into contact and creates a seal. This configuration with a stepped in diameter from the neck and threads increases the biting action at the junction between the components. There is also a greater amount of the base of the mouthpiece portion 202 overlapping with the opening of the container portion 104 then is available in typical configurations without a stepped down diameter portion. These features both facilitate the use of different mouthpiece portions 202 and prevent the device from leaking.

Figure 4:
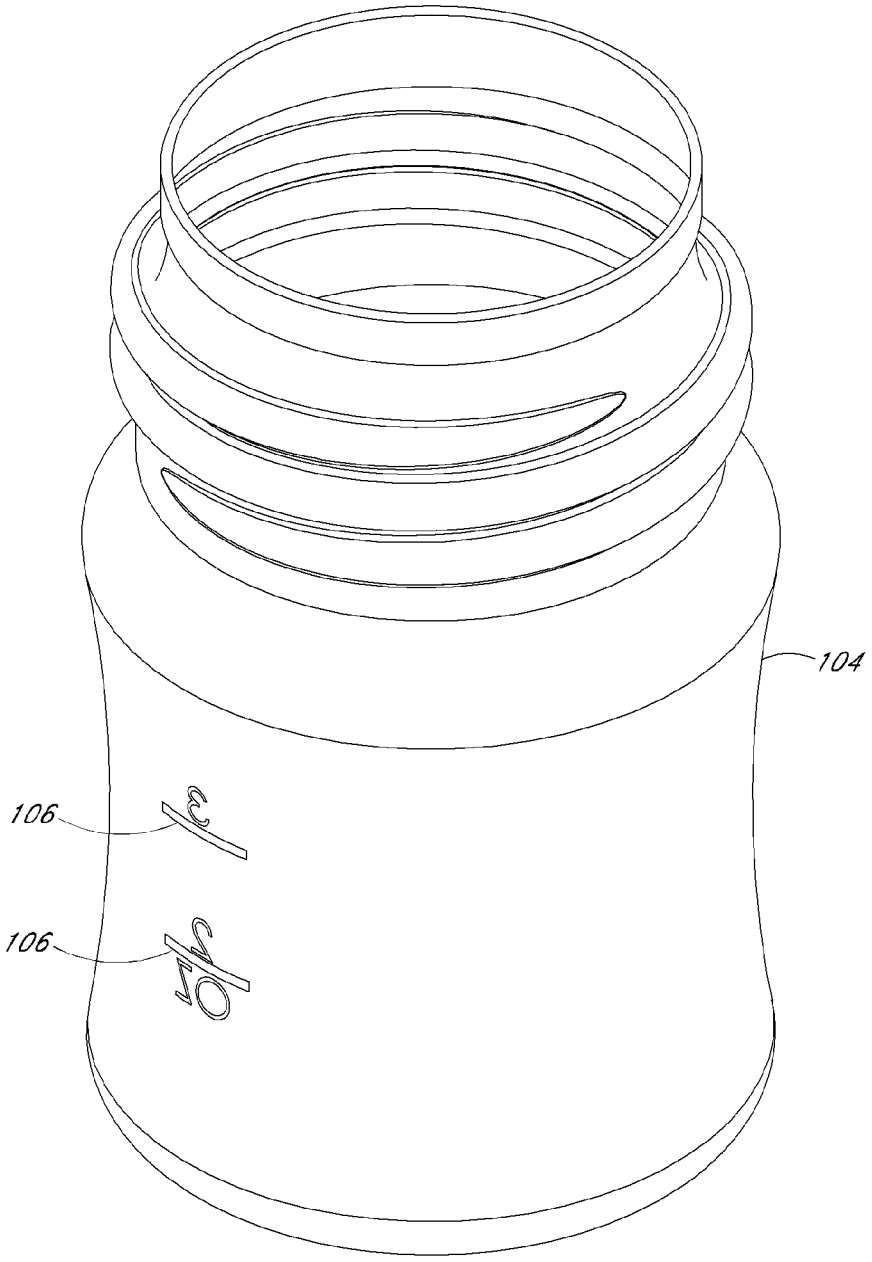
FIG. 4 is a top, front, and right perspective of the container portion of an embodiment of the device.
Figure 5:
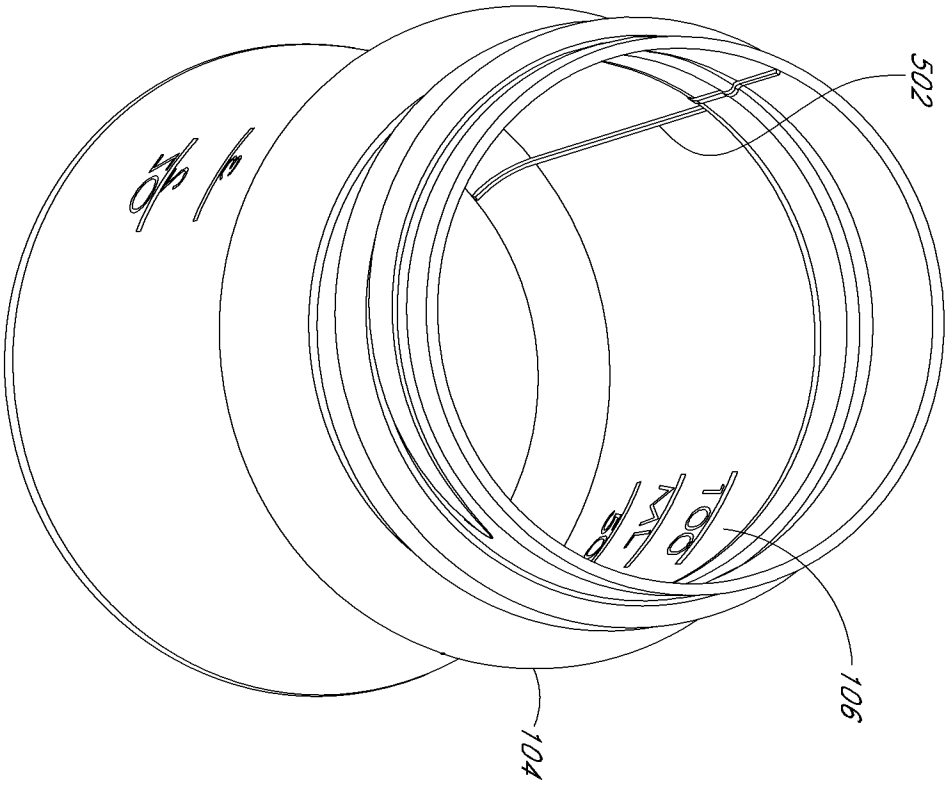
FIG. 5 is a top and rear perspective view of an embodiment of the device.

FIG. 4 illustrates an embodiment of the container portion 104. As described above, the container portion 106 can comprise a plurality of markings 106. In an embodiment, the markings 106 can be pressed into the exterior surface of the container portion 104. The markings 106 can comprise characters that appear backwards when viewed from the exterior of the container portion 104. As illustrated in FIG. 5, which illustrates an interior view of the container portion 104, the markings 106 can comprise characters that appear normally when viewed from the interior chamber of the container portion 104. The container portion 104 can also include one or more seams 502 where the stainless steel material has been welded or soldered together.

FIGS. 6-9 illustrate different elevation views of the container portion 104. In an embodiment, the container portion comprises a generally shallow hourglass configuration. The container portion can be any of many different shapes. Specifically as shown, the diameter of the container portion 104 at a top portion or shoulder 602 and at a bottom portion 604 are larger than the diameter at a mid portion 606 of the container portion 104. As illustrated, the container portion 104 can comprise threads 304 in the neck portion 302. In an embodiment the threads are pressed into the neck such that the threads 304 extend radially outwardly. The threads can have a thickness or height of about 3.8 mm+/−0.25 mm. The thickness or height of the threads 304 can range between about 0.5 mm and about 5.0 mm. The width of the threads 304 can comprise a width of about 4 mm. The width of the threads 304 can range between about 1 mm and about 8 mm. In an embodiment, the threads 304 can comprise a pitch of about 6. The pitch of threads 304 can range between about 2 and about 8. The externally threaded neck portion 302 can be configured to allow the annular portion 204 to be fully seated on the container portion 104 in about 1⅓ revolutions of the annular portion 204. The number of revolutions needed to fully seat the annular portion 204 on the container portion 104 can range from about 1 revolution to about 3 revolutions. One of ordinary skill in the art will understand that 1 revolution is about 360°. By limiting the number of revolutions necessary to fully seat the annular portion 204 on the container portion 104, the user can quickly and simply couple the annular portion 204 to the container portion 104 and remove the annular portion 204 from the container portion 104.

Figures 6, 7, 8, 9:
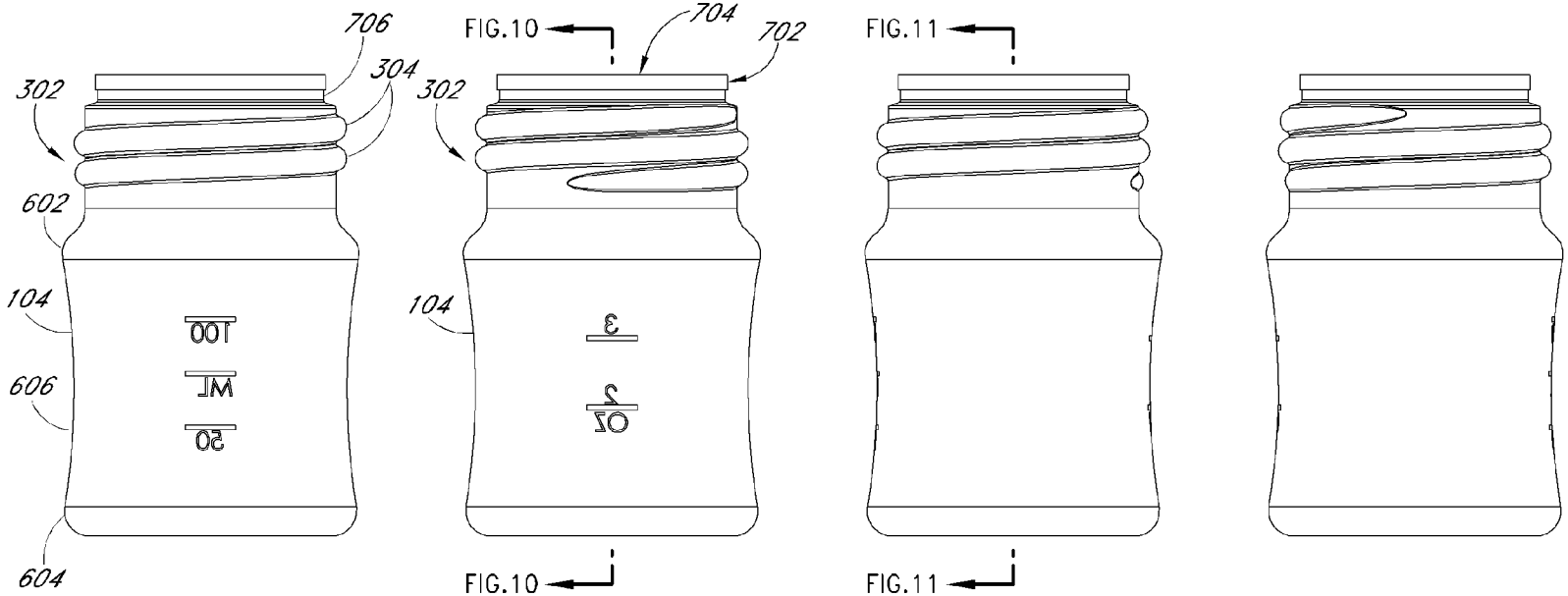
FIG. 6 is a rear elevation view of an embodiment of the device.
FIG. 7 is a front elevation view of an embodiment of the device.
FIG. 8 is a right side elevation view of an embodiment of the device.
FIG. 9 is a left side elevation view of an embodiment of the device.

The neck portion 302 can be inline with, the same or different shape as or a different diameter than the top portion 602. As shown, the top portion 602 forms a shoulder that steps down the outer diameter to the neck portion 302. The neck portion 302 shown has a smaller outer diameter than the top portion 602. In some embodiments, the neck portion 302 can include a further step down 706 in outer diameter (FIG. 6). The step down 706 can increase the amount of the base of the mouthpiece portion 202 that extends pasts the opening and can be used to provide a better seal with a larger number of mouthpiece portions 202.

The neck portion 302 can comprise a lip portion 702. The lip portion 702 can be formed by folding the stainless steel material of neck portion 302 outward and pressed against the exterior portion of neck portion 302. This can form a reinforced ridge. In an embodiment, the height of the folded over lip portion 702 is about 3.0 mm or 3.5 mm+/−0.2 mm. The folded over lip portion can have a height that ranges from about 1.0 mm to about 6.0 mm. The thickness of the lip portion 702 (referring to the folded stainless steel material together with the wall of the neck portion 302) is about 1.2 mm. The thickness of the lip portion can range between about 0.5 mm to about 3.0 mm. The folded over lip portion 702 can create a first surface 704 that can form a seal with the annular portion 204 or the mouthpiece portion 202 or other component. These dimensions can be advantageous in order for the device 100 to operate in a leak proof manner with mouthpieces having a variety of shapes, sizes, and configurations that have been developed by third party manufacturers. In an embodiment, the lip portion 702 may be folded outwardly, as opposed to folded over, to form a flange, thereby eliminating an internal gap that could otherwise trap bacteria and/or impurities from fluids or other contents stored in the container portion 104.

Some embodiments may have the following dimensions. The container portion can have an outer diameter of 59 mm. The neck portion can have an outer diameter of 49.5 mm with an outer diameter of 51.5 mm at the threads. The opening can have a diameter of 43.5 mm. Where the lip of the opening has a width of 1.2 mm the step in from the neck can be a difference of about 3 mm. All dimensions are approximate and can have a range of at least +/−0.2 mm or 0.4 mm or more.

Some embodiments may have the following dimensions. On the container, height of the neck is 24.4 mm+/−0.25 mm, height to the shoulder is 27.2. +/−0.25 mm, height of the lip is 3.0+/−0.25 mm. On the lid or annular portion, height of the lid is 27.9+/−0.25 mm.

It has been found that seating of the mouthpiece is best achieved when 1) the lid height is 3.5+/−0.50 mm greater than the height of the neck on the container, 2) the height of the lip on the container opening is 3.0 mm, and 3) the width of the lip is 1.2 mm.

It has been found that proper orientation of the lid and mouthpiece on the bottle is best achieved when 1) the height of the lid is 0.7+/−0.50 mm greater than the shoulder height, and 2) the lid rotate a minimum of about 310 degrees (0.86 revolutions).

An important design consideration to minimize leaking and to create a secure hold on a flexible mouthpiece can be the ratio of the lid and lip diameters. For safety, one does not want an infant pulling a nipple out of bottle (choking hazard). One also wants to minimize leaking. If the ratio is too high it is too easy to pull the mouthpiece out (i.e. it is NOT secure), if the ratio is too low the bottle can leak. It has been found that as the ratio gets close to 1.00 the bottle tends to leak. It has been found that a ratio of the inner diameter of the lip on the container to the inner diameter of the lid can be 0.829.

In some embodiments, the container portion 104 is open at the neck portion 302 for receiving a fluid. As has been described, the neck portion 302 can receive the annular portion 204 to close the device 100. The opening at the neck portion 302 can be a wide mouth opening. Wide mouth is a term of art meaning the opening of the container is substantially similar to the outer diameter of the container. This is in contrast to a container with a neck that decreases in diameter such that the opening is substantially smaller than the outer diameter of the container.

The container portion 104 with a wide mouth opening advantageously provides a larger opening in which to pour fluids into the container portion. In addition, as many materials that are plastic free are also non-transparent materials, the wide mouth opening allows a user to better see into the container portion 104 to determine how much fluid has been poured into the container portion 104. This combined with the plurality of markings 106 provides additional benefits to a user.

The wide mouth opening allows the user to better see the markings 106, especially where the markings 106 comprise characters that appear normally when viewed from the interior chamber of the container portion 104.

The wide mouth opening can also allow for a greater number of mouthpieces to be usable with the container portion 104, even if different annular portions would be required. The wide mouth opening provides additional benefits in that it is easier to clean, allows adding larger objects into the container portion such as ice or ice cream, and also allows adding thick fluids such as fruit and/or ice cream smoothies.

Figure 11:
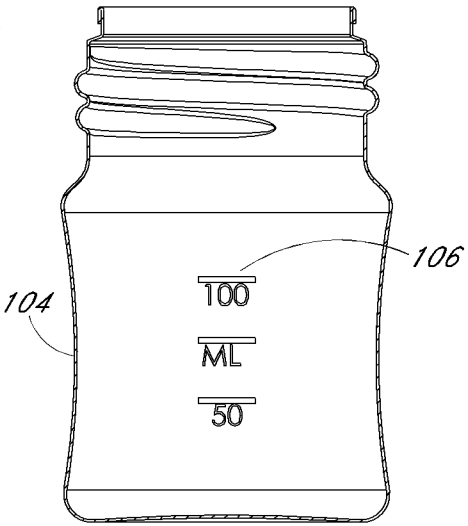
FIG. 11 is a cross-sectional view of an embodiment of the device along line 802 of FIG. 8.
Figure 10:
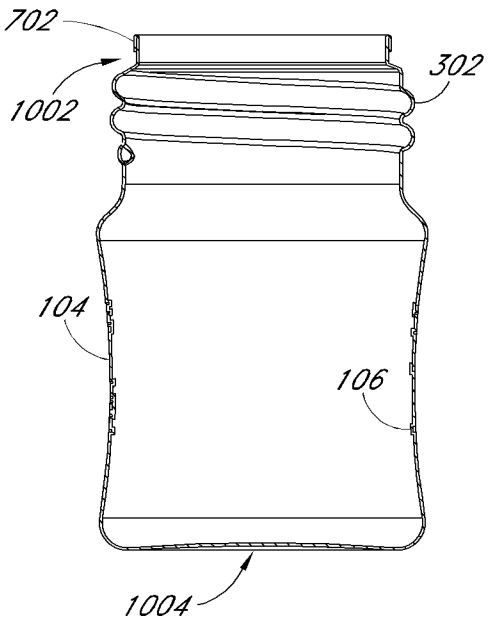
FIG. 10 is a cross-sectional view of an embodiment of the device along line 902 of FIG. 9.
Figure 15:
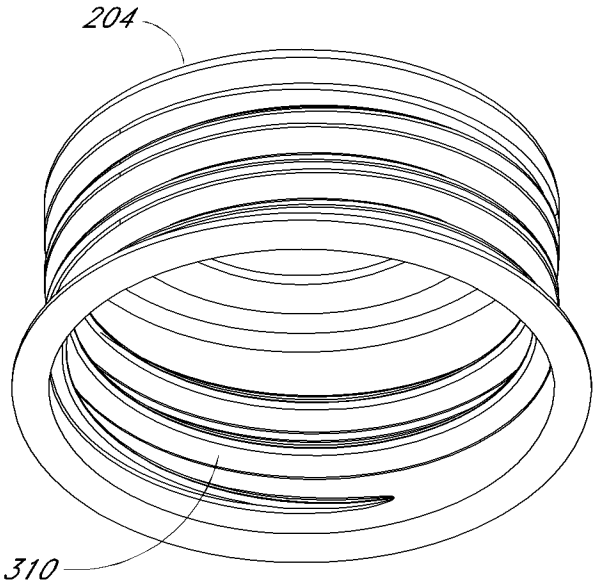
FIG. 15 is a bottom and front perspective view of an embodiment of an annular portion of the device.
Figure 14:
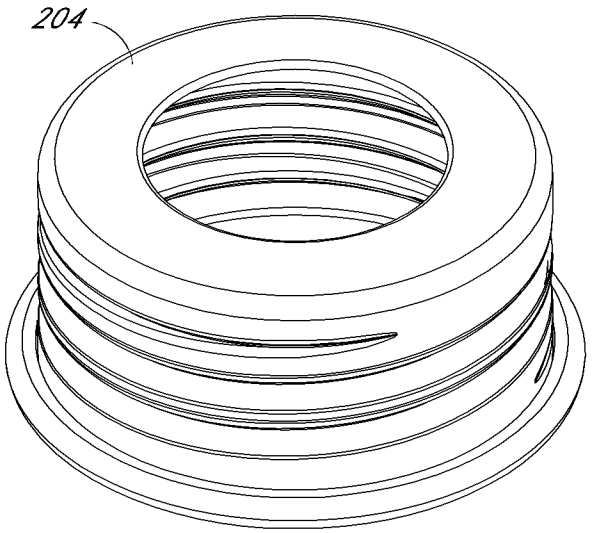
FIG. 14 is a top and front perspective view of an embodiment of an annular portion of the device.

FIGS. 10-11 illustrate cross sectional views of container portion 104 along lines 802 and 902 of FIGS. 8-9. In FIGS. 10-11, the lip or ridge portion 702 is illustrated as formed by folding outwardly the stainless steel material of neck portion 302 to form a gap 1002. By folding outwardly the lip or ridge portion 702, as opposed to folding inwardly the lip or ridge portion 702, the gap 1002 cannot trap bacteria or other materials that can contaminate the fluid or other contents in the inner chamber of the container portion 104. In an embodiment, the container portion 104 can comprise an indented or recessed portion 1004 at the bottom of container portion 104.

Figure 12:
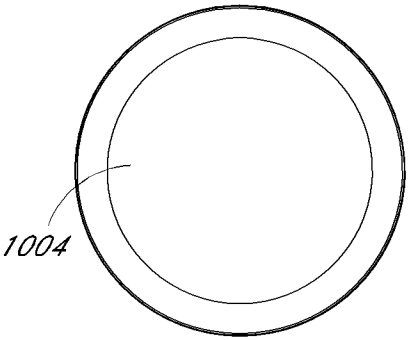
FIG. 12 is a bottom plan view of an embodiment of the device.
Figure 13:
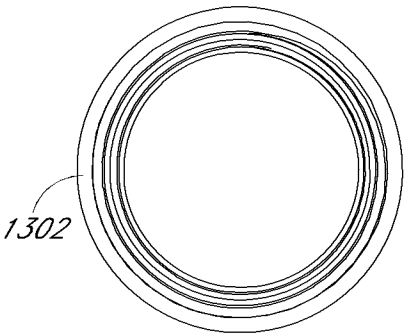
FIG. 13 is a top plan view of an embodiment of the device.

FIG. 12 illustrates the bottom portion 1004 of container portion 104. FIG. 13 illustrates a top plan view of the container portion 104 having side wall 1302.

FIGS. 14-23 illustrate various views of the annular portion 204. The annular portion 204 can be manufactured from stainless steel. The annular portion 204 can comprise a lip or ridge portion 2002. The lip or ridge portion 2002 can be advantageous to the function of the device 100. Specifically, the lip or ridge portion 2002 can aid in securing the mouthpiece portion 202, and can help prevent the second opening 308 from cutting into or otherwise damaging the mouthpiece portion 202. In an embodiment, the lip or ridge portion 2002 can be formed by folding the stainless steel material of the annular portion 204 into the inside of the annular portion 204. This can form a reinforced ridge. As a result, a gap portion 2004 can be formed in the interior of the annular portion 204. In an embodiment, the thickness of the lip or ridge portion 2002 (referring to the folded stainless steel material together with the wall of the annular portion 204) is about 1.1 mm. The thickness of the lip or ridge portion 2002 can range between about 0.5 mm to about 2.0 mm. As illustrated in FIGS. 16-21, the annular portion 204 can comprise an upper surface 1602 that is flat or angled where the mouthpiece portion makes contact with the annular portion 204. It has been found that even small angles can increase the propensity of the device to leak. Thus, the upper surface can be flat with no angle or the angle can be about 0°+/−2 degrees from a horizontal reference line 1604 extending between the edges of the annular portion 204. The flat or nearly flat upper surface 1602 can also helps the device to provide a better seal with a larger number of mouthpiece portions 202.

Figure 22:
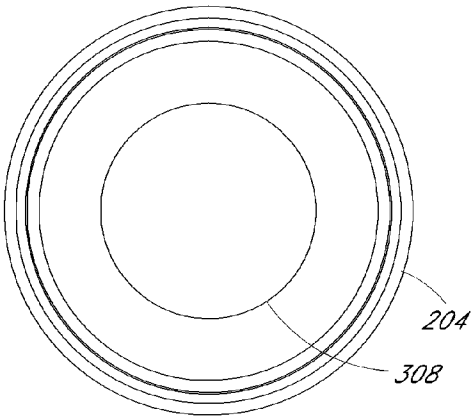
FIG. 22 is a top plan view of an embodiment of an annular portion of the device.
Figure 23:
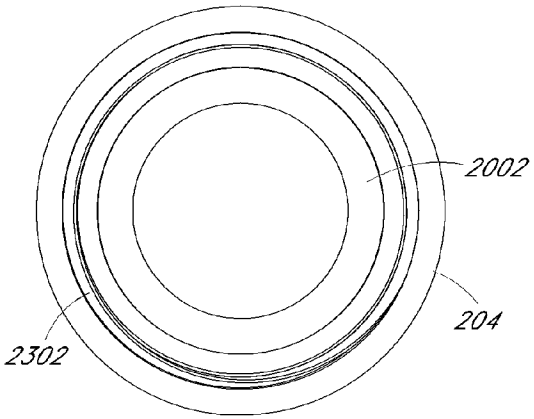
FIG. 23 is a bottom plan view of an embodiment of an annular portion of the device.
Figure 20:
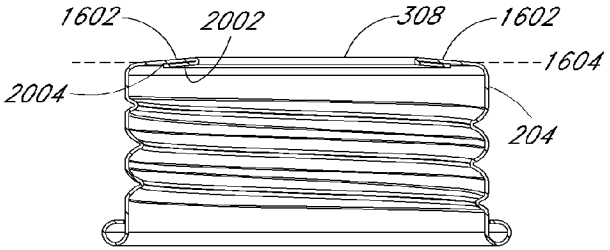
FIG. 20 is a cross-sectional view of an embodiment of an annular portion of the device along line 1802 of FIG. 18.
Figure 21:
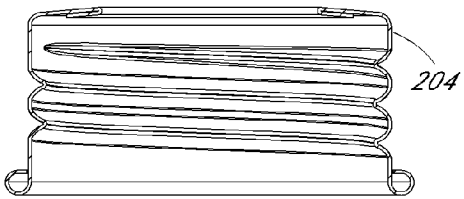
FIG. 21 is a cross-sectional view of an embodiment of an annular portion of the device along line 1902 of FIG. 19.
Figure 24:
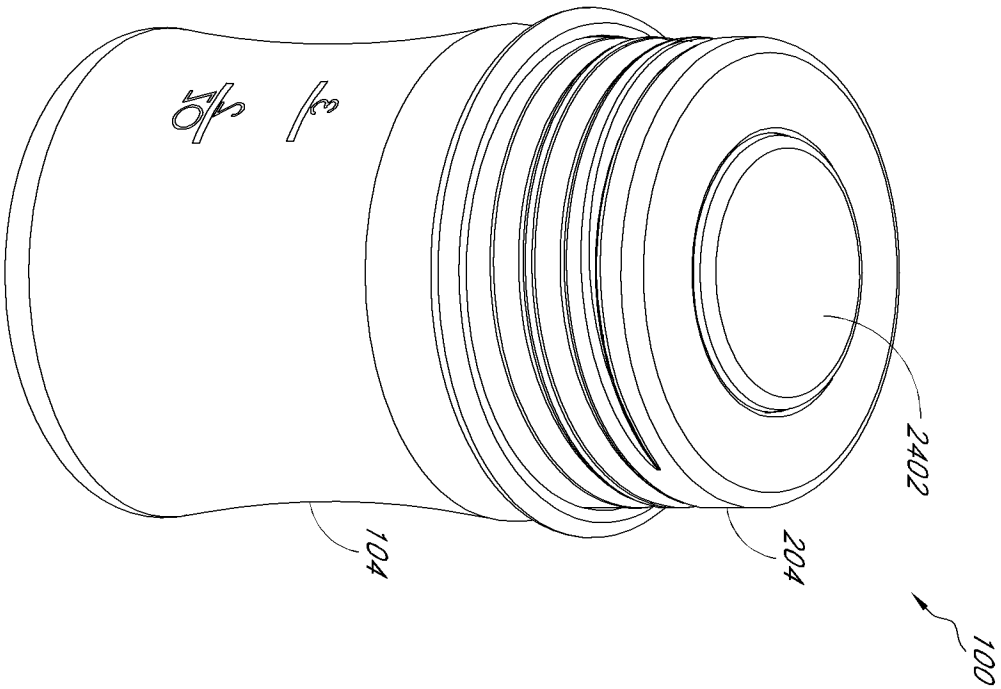
FIG. 24 is a top, front, right side perspective of an embodiment of the device having a cap portion.
Figure 25:
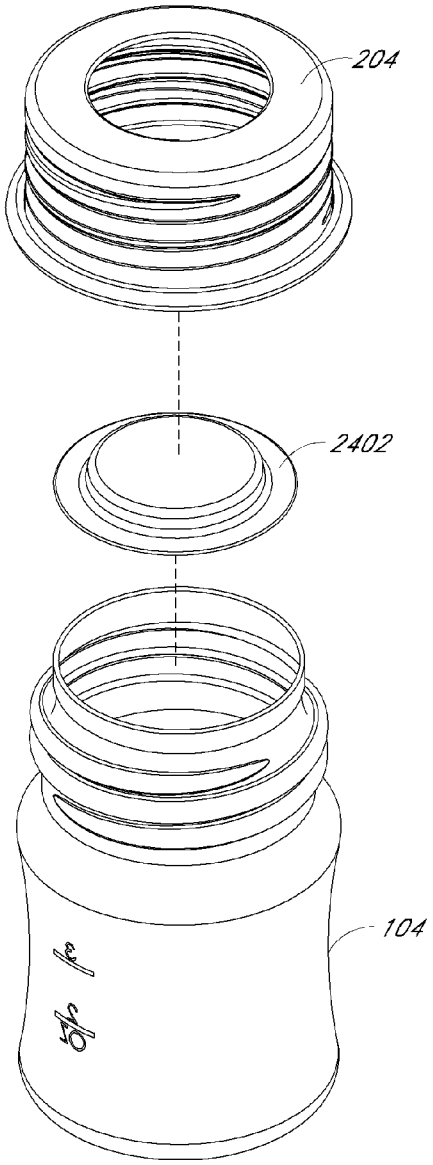
FIG. 25 is a top, front, and right side perspective of the embodiment of FIG. 24 in a disassembled configuration.
Figure 27:
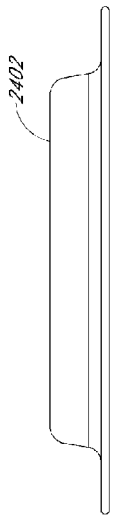
FIG. 27 is a side elevation view of an embodiment of the cap portion.
Figure 26:
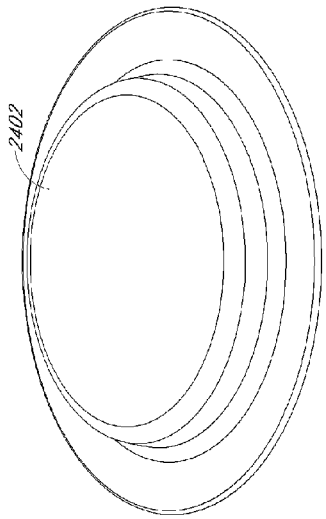
FIG. 26 is a top and front perspective of an embodiment of the cap portion.
Figure 28:
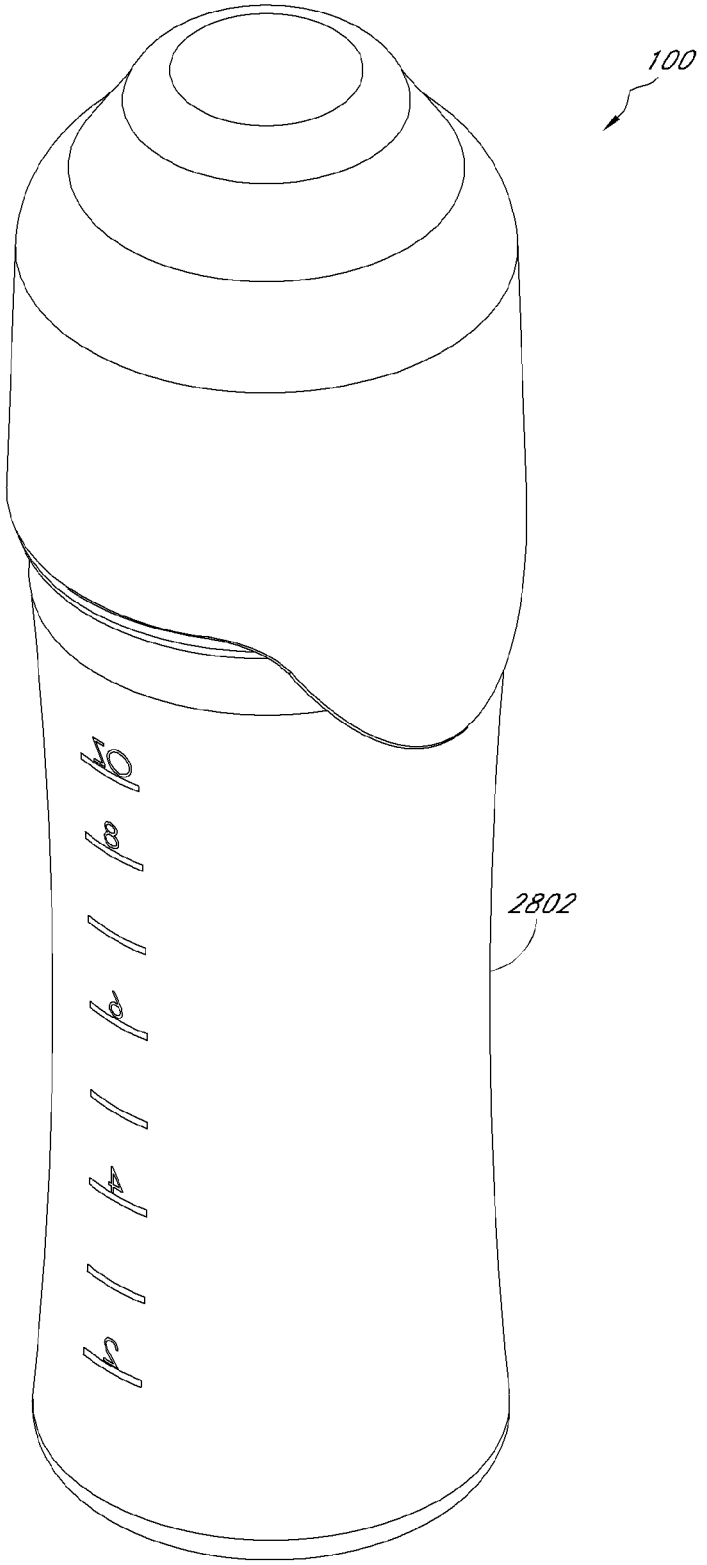
FIG. 28 is a top, front, and right side perspective of an embodiment of the device.
Figure 29:
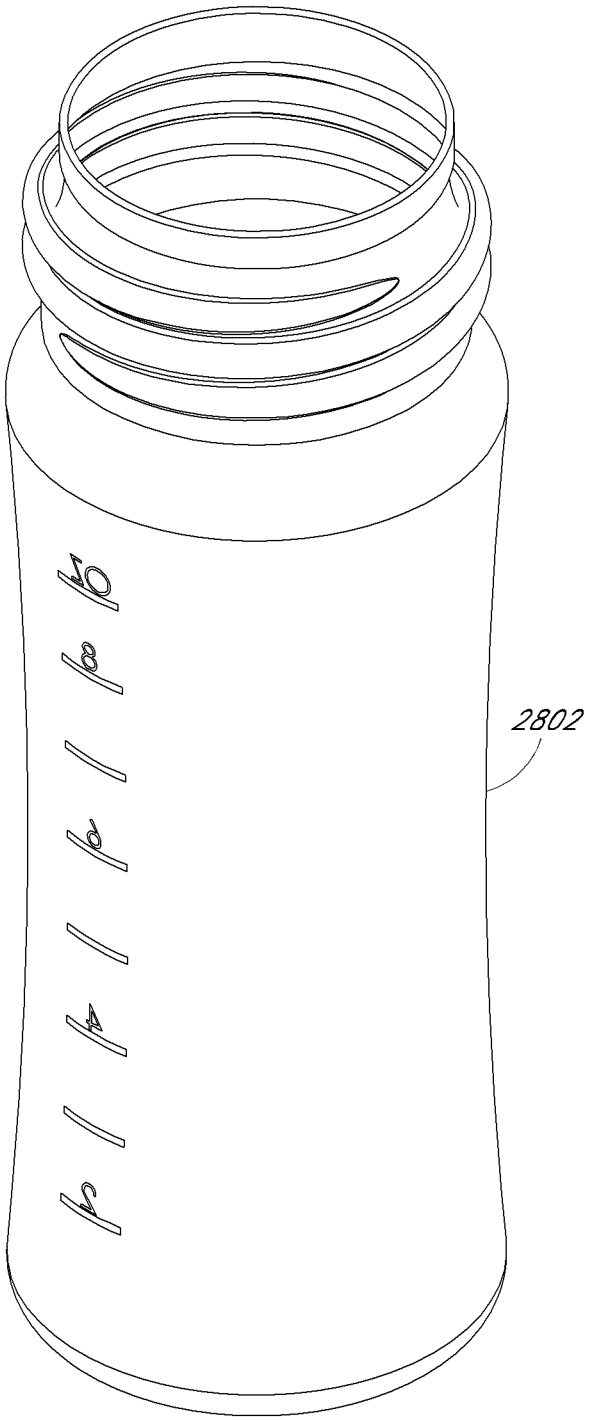
FIG. 29 is a top, front, and right side perspective of an embodiment of a container portion of the device.
Figure 33:
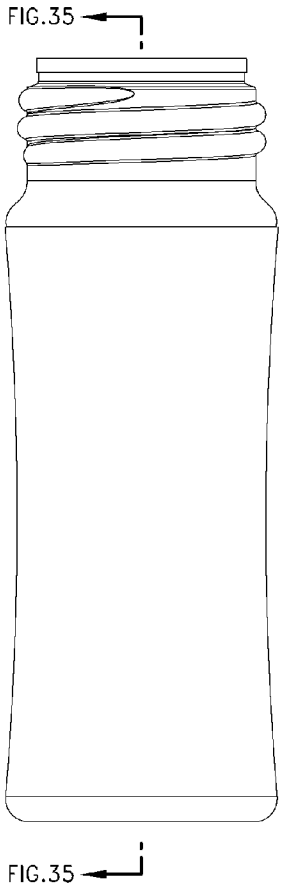
FIGS. 30-33 are side elevation views of an embodiment of a container portion of the device.
Figure 32:
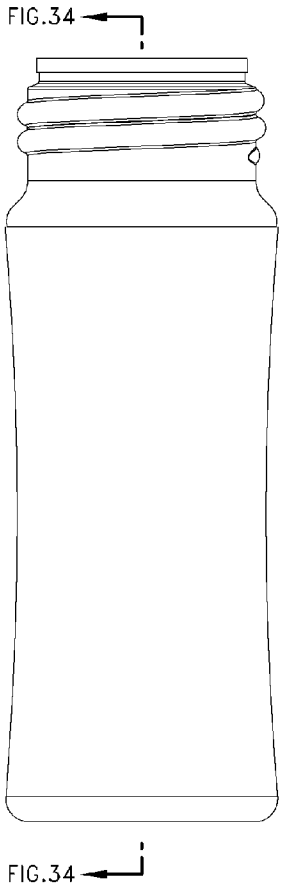
Figure 31:
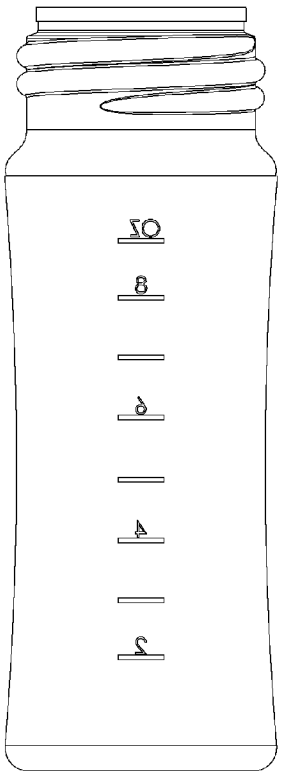
Figure 30:
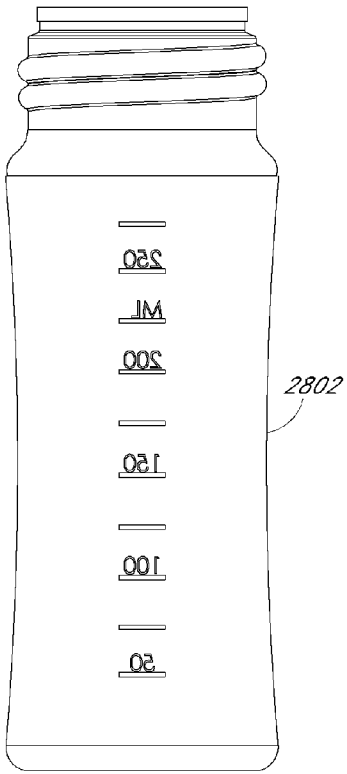
Figure 36:
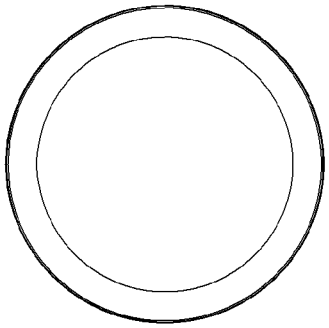
FIG. 36 is a bottom plan view of an embodiment of a container portion of the device.
Figure 37:
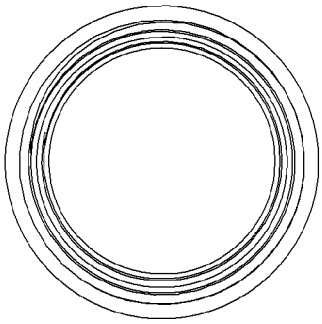
FIG. 37 is a top plan view of an embodiment of a container portion of the device.
Figure 35:
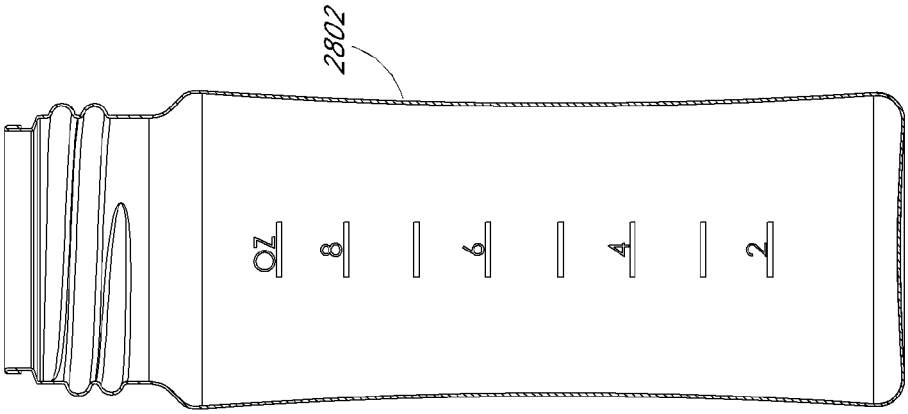
FIGS. 34-35 are cross-sectional views of an embodiment of a container portion of the device.
Figure 34:
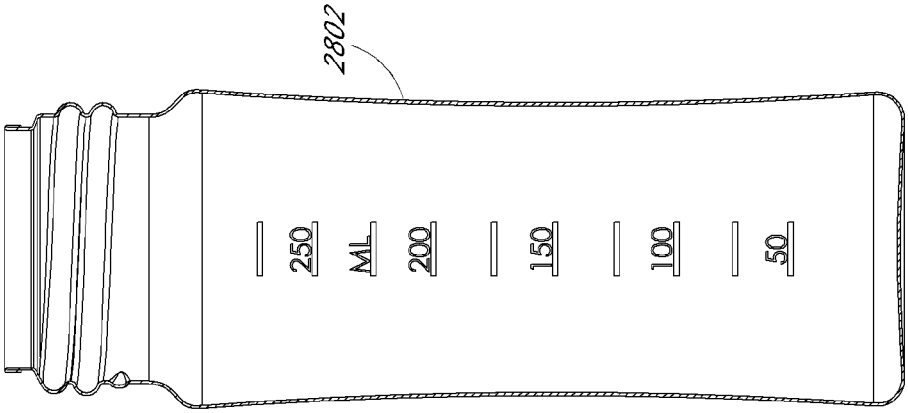

As illustrated in FIG. 22, the annular portion 204 comprises a second opening 308 to allow the mouthpiece portion 202 to extend there through. The diameter of the second opening 308 is about 35 mm+/−0.2 mm. The height of the annular portion 204 can be 27.9 mm with a width at the mid-section of about 53.5 mm. With this configuration, the second opening 308 is configured to receive mouthpiece portions manufactured by a wide variety of manufacturers. The diameter of the second opening 308 can range from about 25 mm to about 40 mm. FIG. 23 illustrates that the annular portion 204 comprises a first opening 2302, 306 having an inner diameter of about 52.5 mm+/−0.2 mm. With this configuration, the first opening 2302, 306 is configured to receive mouthpiece portions manufactured by a wide variety of manufacturers. The inner diameter 2302, 306 can range from about 50 mm to about 55 mm, or about 45 mm to about 60 mm.

FIGS. 24-27 illustrate an embodiment of device 100 having a cap portion 2402 inserted into annular portion 204. In an embodiment, the cap portion 2402 can be manufactured from stainless steel, silicone, or a combination thereof. By manufacturing the cap portion 2402 from stainless steel, silicone, or both, plastic compounds and toxins are prevented from leaching into the fluid or other contents stored in the device 104. The cap portion 2402 can be configured to form a seal between annular portion 204 and container portion 104 thereby preventing the fluid or other contents in the container portion 104 from leaking out. The use of the cap portion 2402 is also useful when the user desires to mix or shake or otherwise combine the contents in the container portion 104.

The cap portion 2402 is shown having a central protrusion. The central protrusion can fit within the opening 308 in the annular portion 204. In some embodiments the central protrusion has a top and bottom wherein the top has a smaller outer diameter than the bottom, as shown. In some embodiment, the top can have a larger outer diameter than the bottom. Independent of the configuration, the cap portion 2402 can be made to form a friction fit or a snap fit with the opening 308 in the annular portion 204.

In some embodiments, the cap portion 2402 can serve as a universal base from which different mouthpiece portions can be derived. For example, a spout or pop top can be added to the base defined by the cap portion 2402.

FIGS. 28-37 illustrate device 100 having a container portion 2802 with an extended length.

FIGS. 38, 39-42 illustrate an embodiment of a mouthpiece portion 202 for inserting into an annular portion 204. As shown, the mouthpiece portion 202 comprises a nipple, such as could be used by a baby or infant. In an embodiment, the mouthpiece portion 202 comprises a radially extending base member and an optional flange 3902 that extends downwardly from the base member. The flange 3902 can be configured to be inserted into an opening of the container portion 104. By allowing the flange 3902 to be seated in the container portion 104, the user need not insert the mouthpiece portion 202 through the annular portion before coupling the annular portion to the container portion 104. In some cases, this can simplify the coupling of the annular portion 204 to the container portion 104. Additionally, the flange portion 3902 can be helpful in forming a secondary seal to prevent fluid or other contents in container portion 104 from leaking out. In an embodiment, the mouthpiece portion 202 to be inserted into the annular portion 204 is manufactured from silicone, and more preferably medical grade silicone to prevent plastic compounds and toxins from leaching into the fluid or other contents stored in the device 104.

Figure 38A:
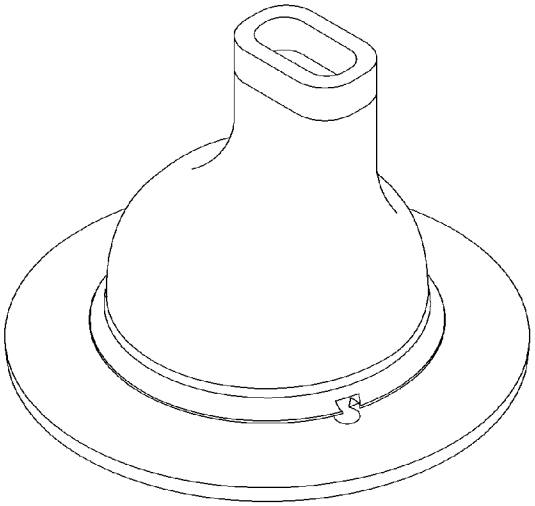
FIG. 38A is a top perspective of another embodiment of a mouthpiece.
Figure 39:
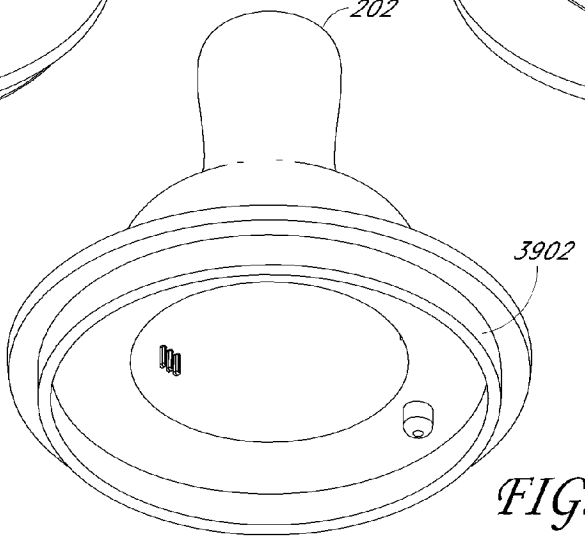
FIG. 39 is a bottom perspective of an embodiment of a mouthpiece portion.
Figure 38:
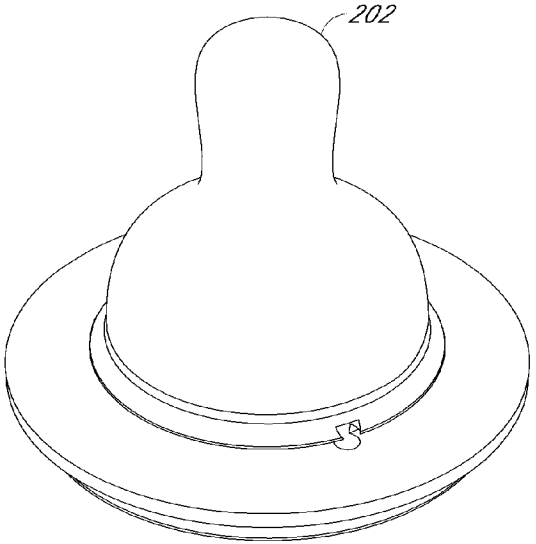
FIG. 38 is a top perspective of an embodiment of a mouthpiece portion.
Figure 42:
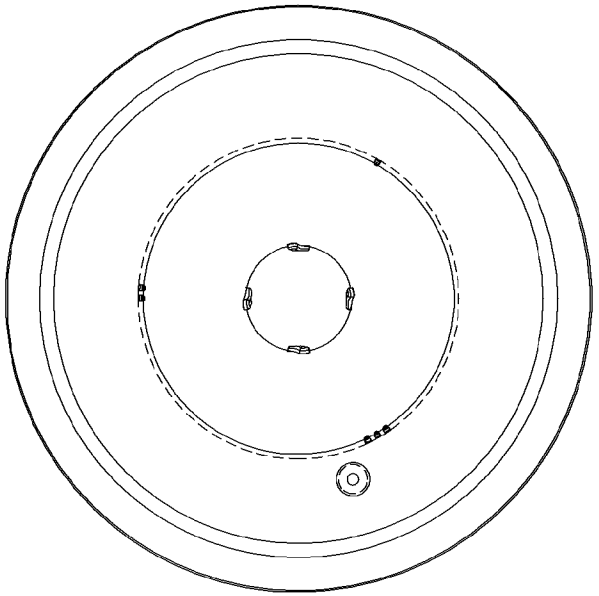
FIG. 42 is a bottom plan view of an embodiment of a mouthpiece portion.
Figure 40:
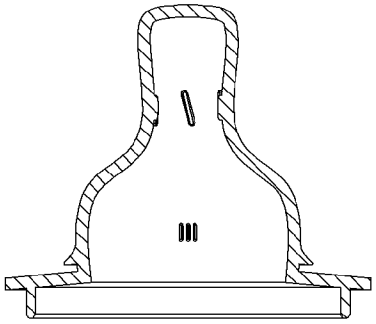
FIGS. 40-41 are cross-sectional views of an embodiment of a mouthpiece portion.
Figure 41:
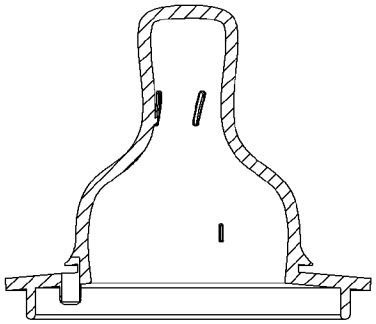
Figure 44:
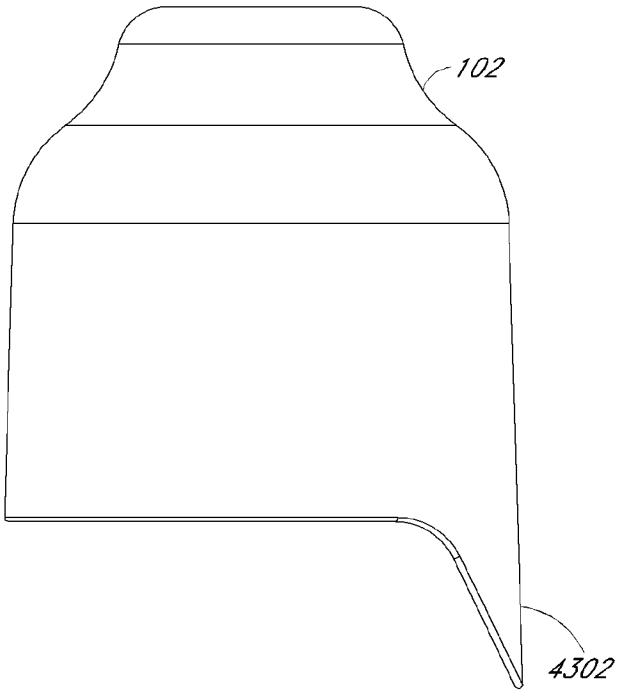
FIG. 44 is a left side elevation view of an embodiment of a cover portion.
Figure 43:
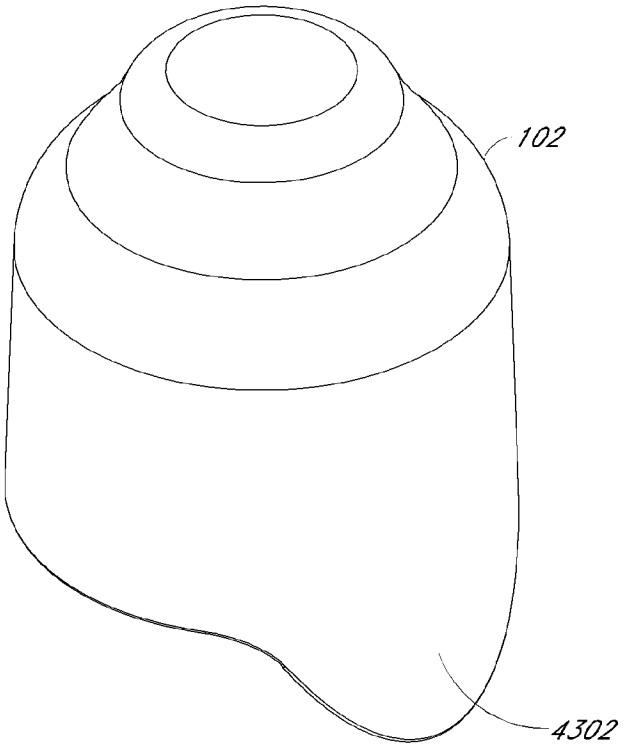
FIG. 43 is a top, front, and left side perspective of an embodiment of a cover portion.
Figure 46:
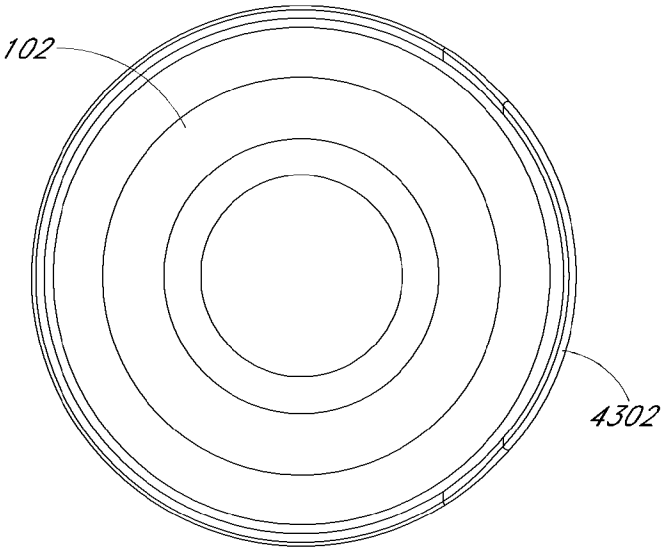
FIG. 46 shows a bottom plan view of an embodiment of a cover portion.
Figure 45:
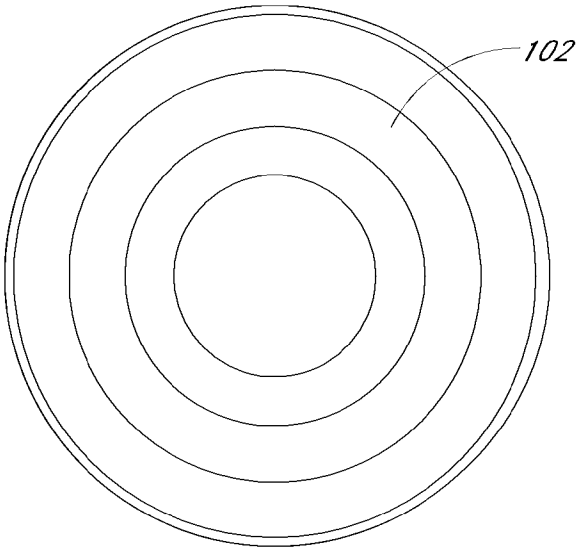
FIG. 45 shows a top plan view of an embodiment of a cover portion.

A mouthpiece portion is shown in FIG. 38A that is similar in some respects to the illustrated mouthpiece portion. One difference being that the mouthpiece portion in FIG. 38A comprises a spout. In addition, the spout does not include the downward extending flange 3902. In other embodiments, the spout can include a downward extending flange. As has been mentioned, the device can use one of a variety of different mouthpiece portions in addition to those shown herein.

FIGS. 43-46 illustrate an embodiment of cover portion 102. In an embodiment, the cover portion 102 can comprise a handle portion 4302 that can simplify removal of the cover portion 102 from the container portion 104. The cover portion 102 can be manufactured from silicone, and preferably medical grade silicone to prevent plastic compounds and toxins from contacting the mouthpiece portion 202 or other spout coupled to the container portion 104, or leaching into the fluid or other contents stored in the device 104.

A cover portion 102 made of silicone can provide additional benefits over the prior art plastic lids. In particular, plastic lids often attach with a snap fit design. This leads to a tight fit but, the lid can easy come disconnected when it experiences a side impact. As it is common for a bottle to be placed in a diaper bag together with books, toys, wallets and other products the prior art lids often come undone, spilling their contents. A silicone cover portion 102 can form a tight friction fit with the annular portion that can easily be removed by the user but will not easily disconnected by a impact, or other motion that would like disconnect a snap fit plastic lid. The cover portion 102 can be flexible and/or slightly sticky to help the cover portion 102 stay in place independent of the impacts experienced.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Additionally, it is contemplated that various aspects and features of the invention described can be practiced separately, combined together, or substituted for one another, and that a variety of combination and sub-combinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A fluid dispenser system useful for storing and delivering fluid, the fluid dispenser system comprising:

a stainless steel container portion defining an inner chamber and having a first end and a second end, the first end is closed and forms a base of the inner chamber, the second end having an opening and a cylindrical neck portion, the cylindrical neck portion comprising a top rim adjacent the opening, the cylindrical neck portion further comprising a male thread having a major diameter larger than a diameter of the opening;

a stainless steel annular portion configured to be coupled to the stainless steel container portion at the cylindrical neck portion, the stainless steel annular portion comprising:

a side wall forming a first circular opening having a first diameter, the side wall comprising a female thread adjacent the first circular opening, the female thread configured to engage the male thread of the cylindrical neck portion to couple the stainless steel annular portion to the stainless steel container portion; and a lip portion comprising a top layer and a bottom layer, the top layer extending inwardly from a top portion of the side wall to an inner edge, the top layer being entirely straight between the side wall and the inner edge, the bottom layer formed from extending the top layer to fold under and be positioned flat against the top layer, the bottom layer extending from the inner edge to an outer edge of the bottom layer, the top layer and the bottom layer being in contact with a sealing portion of a mouthpiece portion, wherein the top layer and bottom layer of the lip portion comprise a combined thickness within a range of 0.5 millimeters to 2.0 millimeters, and wherein the inner edge of the lip portion forms a second circular opening having a second diameter, the first diameter being larger than the second diameter, wherein the outer edge of the bottom layer is sized such that a first annular contact region between the sealing portion of the mouthpiece portion and the top rim of the container portion is positioned outwardly of the outer edge of the bottom layer, wherein the top layer is shaped such that a second annular contact region between the top layer and the sealing portion of the mouthpiece portion extends outwardly beyond the first annular contact region; and the mouthpiece portion having the sealing portion and a protruding end extending therefrom sized and configured to engage a human oral cavity, the mouthpiece portion having an aperture configured to be in fluid communication with the inner chamber of the stainless steel container portion, the mouthpiece portion removably mountable in the stainless steel annular portion to allow the protruding end to extend through the second circular opening of the stainless steel annular portion.

2. The fluid dispenser system of claim 1, wherein the stainless steel annular portion further comprises a rolled edge adjacent the first circular opening, the rolled edge having an outer diameter larger than the first diameter of the first circular opening, the rolled edge forming a hollow annular cavity.

3. The fluid dispenser system of claim 1, wherein the female thread of the stainless steel annular portion comprises a pitch within a range of 2 millimeters to 8 millimeters.

4. The fluid dispenser system of claim 1, wherein the female thread of the stainless steel annular portion comprises a pitch of about 6 millimeters.

5. The fluid dispenser system of claim 1, wherein the female thread of the stainless steel annular portion and the male thread of the stainless steel container portion are configured to enable the annular portion to be fully seated onto the container portion in about 1⅓ revolutions of the annular portion.

6. The fluid dispenser system of claim 1, wherein the top layer and bottom layer of the lip portion comprise a combined thickness within a range of 0.9 millimeters to 1.3 millimeters.

7. The fluid dispenser system of claim 1, wherein the top layer and bottom layer of the lip portion comprise a combined thickness of about 1.1 millimeters.

8. The fluid dispenser system of claim 1, wherein the bottom layer of the lip portion is configured to compress the mouthpiece sealing portion against the top rim of the stainless steel container portion, and the bottom layer of the lip portion is flat and smooth to prevent cutting into or damaging the mouthpiece sealing portion.

9. The fluid dispenser system of claim 1, wherein the mouthpiece portion comprises silicone.

10. A stainless steel lid portion of a fluid dispenser system useful for storing and delivering fluid, the stainless steel lid portion comprising:

an annular side wall forming a first circular opening having a first diameter, the annular side wall comprising a female thread adjacent the first circular opening, the female thread configured to engage a male thread of a stainless steel container portion of the fluid dispenser system to couple the stainless steel lid portion to the stainless steel container portion, the stainless steel container portion defining an inner chamber and having a first end and a second end, the first end is closed and forms a base of the inner chamber, the second end having an opening and a cylindrical neck portion, the cylindrical neck portion comprising a top rim adjacent the opening of the stainless steel container portion, the cylindrical neck portion comprising the male thread, the male thread having a major diameter larger than a diameter of the opening of the stainless steel container portion; and a lip portion comprising a top layer and a bottom layer, the top layer extending inwardly from a top portion of the annular side wall to an inner edge, the top layer being entirely straight between the annular side wall and the inner edge, the bottom layer formed from extending the top layer to fold under and be positioned flat against the top layer, the bottom layer extending from the inner edge outwardly toward the annular side wall to an outer edge of the bottom layer, wherein the top layer and bottom layer of the lip portion comprise a combined thickness within a range of 0.5 millimeters to 2.0 millimeters, wherein the inner edge of the lip portion forms a second circular opening having a second diameter, the first diameter being larger than the second diameter, the second circular opening sized to enable removable coupling of the lid portion to a mouthpiece portion of the fluid dispenser system, the mouthpiece portion having a sealing portion and a protruding end extending therefrom sized and configured to engage a human oral cavity, the mouthpiece portion having an aperture configured to be in fluid communication with the inner chamber of the stainless steel container portion, wherein the top layer and the bottom layer are configured to be in contact with the sealing portion of the mouthpiece portion when the lid portion is coupled to the mouthpiece portion and container portion in a fully seated position, wherein the outer edge of the bottom layer is sized such that when the lid portion is coupled to the mouthpiece portion and container portion in the fully seated position, a first annular contact region between the sealing portion of the mouthpiece portion and the top rim of the container portion is positioned outwardly of the outer edge of the bottom layer, wherein the top layer is shaped such that, when the lid portion is coupled to the mouthpiece portion and container portion in the fully seated position, a second annular contact region between the top layer and the sealing portion of the mouthpiece portion extends outwardly be and the first annular contact region.

11. The stainless steel lid portion of claim 10, further comprising:

a rolled edge adjacent the first circular opening, the rolled edge having an outer diameter larger than the first diameter of the first circular opening, the rolled edge forming a hollow annular cavity.

12. The stainless steel lid portion of claim 10, wherein the female thread comprises a pitch within a range of 2 millimeters to 8 millimeters.

13. The stainless steel lid portion of claim 10, wherein the female thread comprises a pitch of about 6 millimeters.

14. The stainless steel lid portion of claim 10, wherein the female thread and the male thread are configured to enable the stainless steel lid portion to be fully seated onto the stainless steel container portion in about 1⅓ revolutions of the stainless steel lid portion.

15. The stainless steel lid portion of claim 10, wherein the top layer and bottom layer of the lip portion comprise a combined thickness within a range of 0.9 millimeters to 1.3 millimeters.

16. The stainless steel lid portion of claim 10, wherein the top layer and bottom layer of the lip portion comprise a combined thickness of about 1.1 millimeters.

17. The stainless steel lid portion of claim 10, wherein the bottom layer of the lip portion is configured to compress the mouthpiece sealing portion against the top rim of the stainless steel container portion, and the bottom layer of the lip portion is flat and smooth to prevent cutting into or damaging the mouthpiece sealing portion.

18. The stainless steel lid portion of claim 10, wherein the mouthpiece portion comprises silicone.

* * * * *